US007104241B2

(12) United States Patent
Utsumi et al.

(10) Patent No.: US 7,104,241 B2
(45) Date of Patent: Sep. 12, 2006

(54) ENGINE FASTENING STRUCTURE

(75) Inventors: Yoji Utsumi, Shizuoka (JP); Masahiro Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/502,881

(22) PCT Filed: Feb. 14, 2003

(86) PCT No.: PCT/JP03/01607

§ 371 (c)(1),
(2), (4) Date: Jul. 29, 2004

(87) PCT Pub. No.: WO03/071116

PCT Pub. Date: Aug. 28, 2003

(65) Prior Publication Data

US 2005/0145211 A1 Jul. 7, 2005

(30) Foreign Application Priority Data

Feb. 20, 2002 (JP) ..... 2002-043837

(51) Int. Cl.
*F02F 11/00* (2006.01)

(52) U.S. Cl. ..... 123/193.3

(58) Field of Classification Search ..... 123/193.3, 123/193.2, 193.5
See application file for complete search history.

(56) References Cited

U.S. PATENT DOCUMENTS

| | | | | |
|---|---|---|---|---|
| 4,465,029 | A | 8/1984 | Matsumoto | |
| 6,036,163 | A * | 3/2000 | Yamada | 248/557 |
| 2003/0098005 | A1 * | 5/2003 | Ito et al. | 123/193.5 |

FOREIGN PATENT DOCUMENTS

| | | |
|---|---|---|
| JP | 60-87355 | 6/1985 |
| JP | 60-134852 | 9/1985 |
| JP | 2-40949 | 3/1990 |
| JP | 3-13449 | 2/1991 |
| JP | 2001-082248 | 3/2001 |

* cited by examiner

*Primary Examiner*—Tony M. Argenbright
*Assistant Examiner*—Katrina Harris
(74) *Attorney, Agent, or Firm*—Hogan & Hartson LLP

(57) ABSTRACT

An engine fastening structure in which a cylinder body and a cylinder head are stacked on and fastened to a crankcase, characterized in that a case side flange portion 3*b* formed at a crankcase side end portion of the cylinder body 3 is fastened to the crankcase 2 with case bolts 30*a*, and at least part of head bolts 30*c* for fastening the cylinder head 4 and the cylinder body 3 together are screwed into the case side flange portion 3*b*.

10 Claims, 19 Drawing Sheets

LEFT-HAND SIDE VIEW

LEFT-HAND SIDE VIEW

RIGHT-HAND SIDE VIEW

RIGHT-HAND SIDE VIEW

LEFT-HAND SIDE VIEW

ENGINE FASTENING STRUCTURE

TECHNICAL FIELD

The present invention relates to an engine fastening structure in which a cylinder body and a cylinder head are stacked on and fastened to a crankcase, and more particular to an engine fastening structure which can improve the durability of the cylinder body by reducing the load due to combustion pressure which is applied to the cylinder body.

BACKGROUND ART

As a fastening structure for a motorcycle engine, for example, there exists an engine fastening structure in which a crankcase side flange portion of a cylinder body is fastened to a crankcase with bolts and a cylinder head side flange portion of the cylinder body is fastened to a cylinder head with bolts.

With the conventional construction, however, in the case of a single cylinder and large displacement engine that is subjected to a large load due to combustion pressure, the large load eventually generates a large tensile stress at an axially intermediate portion of the cylinder body.

Then, conventionally, it is a generally accepted practice to secure a required durability by increasing the thickness of the axially intermediate portion of the cylinder body. However, increasing the thickness of the cylinder body like this constitutes a cause for an increase in the weight of the engine.

On the other hand, as a conventional engine fastening structure which can avoid the increase in the engine weight, there exists, for example, an engine fastening structure disclosed in JP-A-8-28210. In this engine fastening structure, a crankcase side flange portion of a cylinder body 2 is fastened and fixed to a crankcase 3, 4 with case bolts 11, and a cylinder head side flange portion of the cylinder body 2 is fastened and fixed to a cylinder head with bolts 15. Furthermore, the cylinder head 1 is fastened and fixed to the crankcase 3, 4 with bolts 17 which screw through the cylinder body 2.

In the case of the engine fastening structure disclosed in the above publication, since the cylinder head 1 is fastened and fixed to the crankcase 3, 4 with the bolts 17 which screw through the cylinder body 2, part of a combustion pressure applied to the cylinder body is borne by the bolts 17, and stress generated in the cylinder body can be reduced accordingly, thereby making it possible to improve the durability of the cylinder body.

With the engine fastening structure disclosed in the publication, however, while the head bolts are screwed into the crankcase at positions which align with fixing positions of the cylinder head, since there exist cooling water jackets in the cylinder head, the head bolts have to be disposed outwardly so as to avoid the cooling water jackets. Due to this, as seen from the top, the crankcase is fastened at positions which are apart from the axis of a cylinder, and hence the crankcase has to be enlarged accordingly, which would other wise be unnecessary. In addition, the construction is adopted in which the head bolts are screwed into the crankcase, since the head bolts have to be disposed at positions where they do not interfere with a web of a crankshaft and the fixing positions of the cylinder head and fixing positions of the crankcase have to be aligned with each other, the degree of freedom in design is reduced.

The present invention was made in view of the problems inherent in the conventional engine fastening structure, and an object of the invention is to provide an engine fastening structure which can secure the durability of an engine without needing to enlarge a crankcase unnecessarily and without needing to reduce the degree of freedom in arrangement of head bolts.

DISCLOSURE OF THE INVENTION

According to a first aspect of the invention, there is provided an engine fastening structure in which a cylinder body and a cylinder head are stacked on and fastened to a crankcase, characterized in that case bolts passes through a case side flange portion formed at a crankcase side end portion of the cylinder body and are screwed into a cylinder body side end portion of the crankcase to fasten the cylinder body to the crankcase, in that at least part of head bolts which fasten the cylinder head and the cylinder body together is made to be a flange screw-through head bolt and in that the flange screw-through head bolt is screwed into a screw portion formed in the case side flange portion.

According to a second aspect of the invention, there is provided an engine fastening structure as set forth in the first aspect of the invention, characterized in that the flange screw-through head bolt and the case bolt overlap each other by a distance which is substantially the same as the thickness of the case side flange portion in the axial direction of a cylinder bore.

According to a third aspect of the invention, there is provided an engine fastening structure as set forth in the first or second aspect of the invention, characterized in that the flange screw-through bolt and the case bolt are disposed close to each other, when viewed in the axial direction of the cylinder bore.

According to a fourth aspect of the invention, there is provided an engine fastening structure as set forth in any of the first to third aspects of the invention, characterized in that the case bolt is disposed such that a distance from the case bolt to a first straight line which passes through the axis of the cylinder bore and which is normal to a crankshaft becomes shorter than a distance from the flange screw-through head bolt to the first straight line, when viewed in the axial direction of the cylinder bore.

According to a fifth aspect of the invention, there is provided an engine fastening structure as set forth in any of the first to fourth aspects of the invention, characterized in that the flange screw-through head bolt is disposed such that a distance from the head bolt to a second straight line which passes through the axis of a cylinder bore and which is parallel to the crankshaft becomes shorter than a distance from the case bolt to the second straight line, when viewed in the axial direction of the cylinder bore.

According to a sixth aspect of the invention, there is provided an engine fastening structure as set forth in any of the first to fifth aspects of the invention, characterized in that an upper flange portion is formed at a cylinder head side end portion of the cylinder body, in that the flange screw-through head bolt passes the upper flange portion and is screwed into the case side flange portion, and in that a part of the flange screw-through head bolt which is between the case side flange portion and the upper flange portion is exposed to the outside.

According to a seventh aspect of the invention, there is provided an engine fastening structure as set forth in any of the first to sixth aspects of the invention, characterized in that at least three head bolts are disposed on either side of the cylinder bore across the second straight line, when viewed in the axial direction of the cylinder bore, and in that the central head bolt along the second straight line is set to have a length which does not reach the case side flange portion.

According to an eighth aspect of the invention, there is provided an engine fastening structure as set forth in any of the first to seventh aspects of the invention, characterized in that the flange screw-through head bolt is disposed between a chain compartment formed on a side to the cylinder bore in which a camshaft driving chain which connects the crankshaft to a camshaft is disposed and the cylinder bore.

According to a ninth aspect of the invention, there is provided an engine fastening structure as set forth in any of the first to eighth aspects of the invention, characterized in that the flange screw-through head bolt is screwed into the case side flange portion at one end and is fastened and fixed to the cylinder head with a cap nut at the other end thereof.

According to a tenth aspect of the invention, there is provided an engine fastening structure as set forth in the first aspect of the invention, characterized in that a tip of the flange screw-through head bolt is positioned closer to a cylinder body side than a cylinder body side end surface of the crankcase.

BEST MODE FOR CARRYING OUT THE INVENTION

Figure 1:
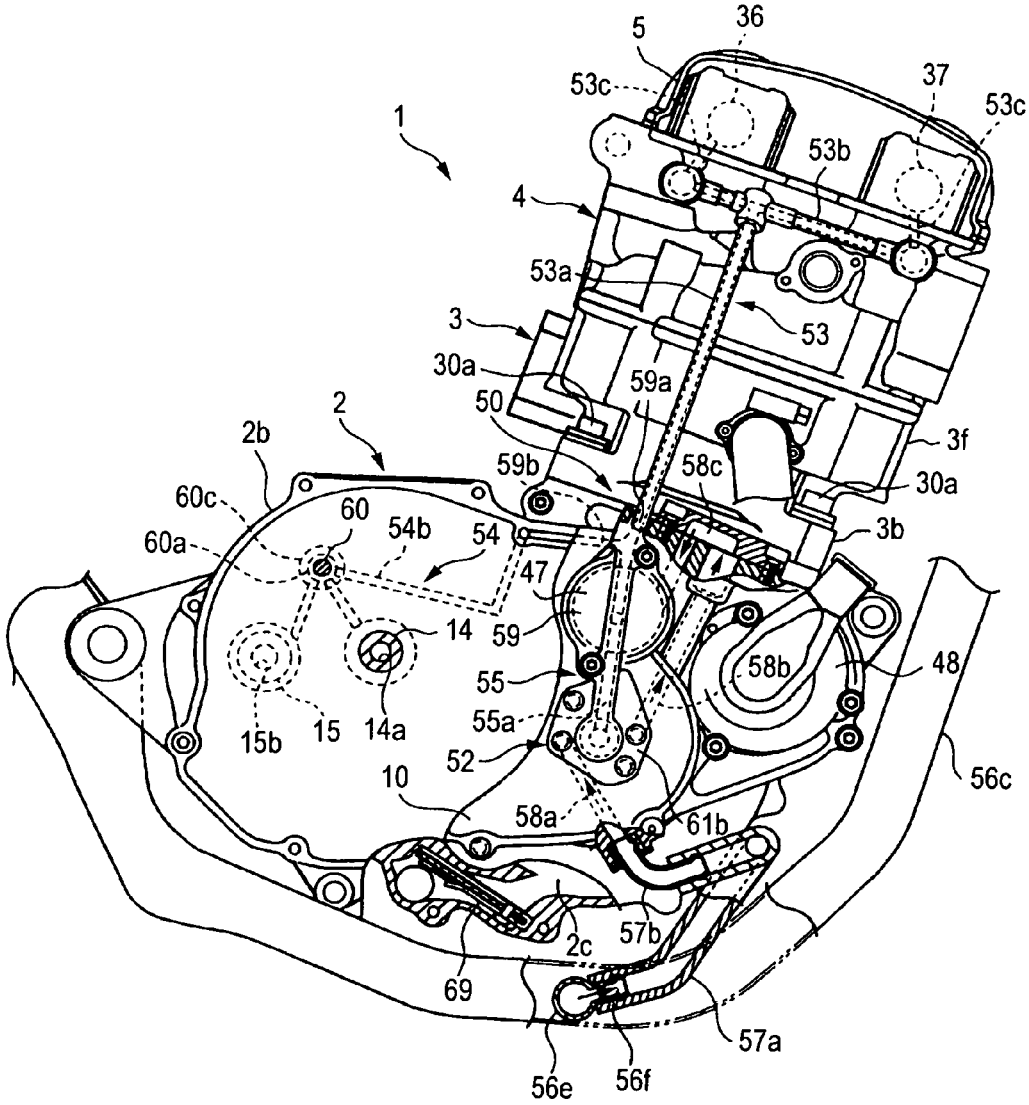
FIG. 1 is a right-hand side view of an engine according to an embodiment of the invention.
Figure 2:
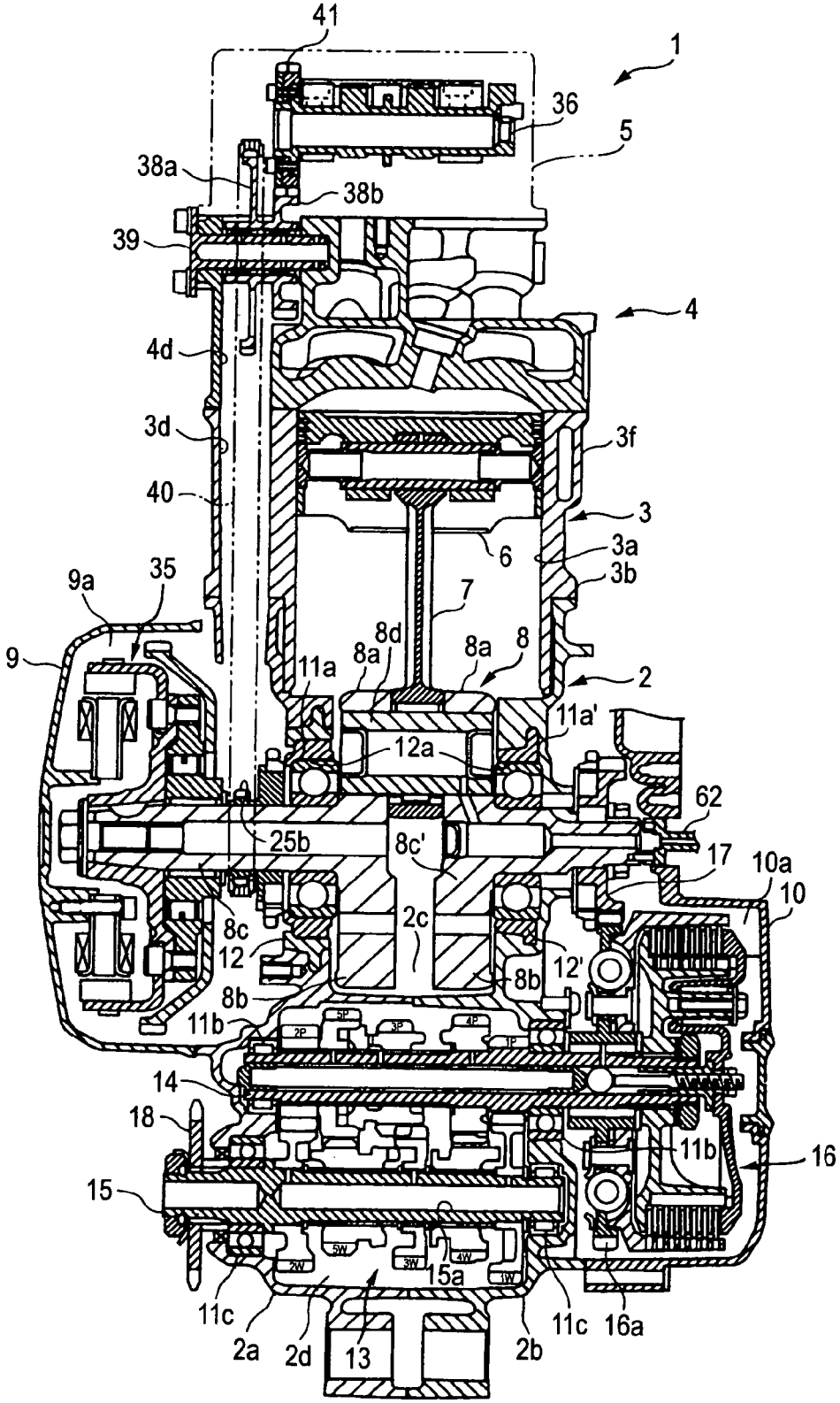
FIG. 2 is a sectional plan view showing a development of the engine.

Hereinafter, an embodiment of the invention will be described with reference to the accompanying drawings.

FIGS. 1 to 21 are drawings for describing an embodiment of the invention. In the drawings, reference numeral 1 denotes a water-cooled, 4-cycle, single cylinder, 5-valve engine, and in general, the engine has a construction in which a cylinder body 3, a cylinder head 4 and a cylinder head cover 5 are stacked on and fastened to a crankcase 2, and a piston 6 slidably disposed in a cylinder bore 3*a* in the cylinder body 3 is connected to a crankshaft 8 via a connecting rod 7.

The cylinder body 3 and the crankcase 2 are securely connected together by screwing four case bolts 30*a* which pass through a lower flange portion (a case side flange portion) 3*b* into a cylinder side mating surface 2*e* of the crankcase 2. To be more specific, the case bolts 30*a* are screwed into bolt connecting portions (connecting boss portions) 12*c* of iron alloy bearing brackets 12, 12' (which will be described later on) embedded in left and right wall portions of the aluminum alloy crankcase 2, respectively, through insert casting. Note that reference numeral 31*a* in FIG. 10 denotes a positioning dowel pin for positioning the crankcase 2 and the cylinder body 3.

In addition, the cylinder body 3 and the cylinder head 4 are connected together with two short head bolts 30*b* and four long head bolts (flange screw-through head bolts) 30*c*. The short head bolt 30*b* is screwed to be planted in a portion below an induction port 4*c* and a portion below an exhaust port in the cylinder head 4, extends downwardly to pass through an upper flange portion 3*f* of the cylinder block 3 and protrudes downwardly therefrom. Then, a cap nut 32*a* is screwed on the downwardly protruding portion of the short head bolt 30*b*, whereby the upper flange portion 3*f* and hence the cylinder body 3 are fastened to a cylinder side mating surface 4*a* of the cylinder head 4.

In addition, the long head bolt 30*c* is screwed to be planted in the lower flange portion 3*b* of the cylinder body 3, extends upwardly to pass from the upper flange portion 3*f* of the cylinder block 3 through a flange portion 4*b* of the cylinder head 4 and protrudes upwardly therefrom. Then, a cap nut 32*b* is screwed on the upwardly protruding portion of the long head bolt 30*c*, whereby the lower flange portion 3*b* and hence the cylinder body are fastened to the cylinder side mating surface 4*a* of the cylinder head 4. Note that a portion 30*c*' of the long head bolt 30*c* which is situated between the lower flange portion 3*b* and the upper flange portion 3*f* of the cylinder body 3 is exposed to the outside.

Here, when viewed in a direction normal to the axis A of the cylinder bore (refer to FIG. 10), the long head bolt 30*c* and the case bolt 30*a* overlap each other by a distance which is substantially the same as the thickness of the lower flange portion (the case side flange portion) 3*b* along the axis A of the cylinder bore.

In addition when viewed in a direction along the axis A of the cylinder bore (refer to FIGS. 6, 7), the long head bolt 30*c* and the case bolt 30*a* are disposed so as to establish the following relationship and close to each other. Namely, the case bolt 30*a* is disposed such that a distance a1 from the case bolt 30*a* to a first straight line C1 which passes through the axis A of the cylinder bore and which is normal to the crankshaft becomes shorter than a distance a2 from the head bolt 30*c* to the first straight line C1 or such that the case bolt 30*a* is situated closer to the center of the cylinder bore as viewed in the direction of the crankshaft.

In addition, the head bolt 30*c* is disposed such that a distance b2 from the head bolt 30*c* to a second straight line C2 which passes through the axis A of the cylinder bore and which is parallel to the crankshaft is shorter than a distance b1 from the case bolt 30*a* to the second straight line C2 or such that the head bolt is situated closer to the crankshaft side.

Furthermore, three head bolts 30*c*, 30*b*, 30*c* are disposed on either side of the cylinder bore across the second straight line C2, and of these three head bolts, the head bolt situated centrally along the direction of the second straight line C2 is made to be the short head bolt 30*b*. This short head bolt 30*b* is set to have a length which corresponds to the upper flange portion 3*f* and which does not reach the lower flange portion 3*b*.

Then, the long head bolts 30*c*, 30*c* are disposed on either side of the cylinder bore across the second straight line C2. Here, on one side of the cylinder bore 3*a* along the direction of the crankshaft (on a left-hand side of FIG. 7), a chain compartment 3*d* is formed in which a camshaft driving chain 40 for transmitting the rotation of the crankshaft to the camshaft is disposed. The long head bolts 30*c* situated on the one side of the cylinder bore along the direction of the second straight line C2 are disposed between the chain compartment 3*d* and the cylinder bore 3*a*.

Thus, in connecting the cylinder body 3 and the cylinder head 4 together, since not only is the upper flange portion 3*f* of the cylinder body 3 fastened and fixed to the cylinder head 4 with the short head bolts 30*b* and cap nuts 32*a* but also the long head bolts 30*c* are planted in the lower flange portion 3*b* which is bolted and connected to the mating surface 2*e* of the crankcase 2, so that the cylinder body 3 is fastened and fixed to the flange portion 4*b* of the cylinder head 4 with the long head bolts 30*c* so planted and cap nuts 32*b*, the tensile load due to the combustion pressure is borne by the cylinder body 3 and the four long head bolts 30*c*, and therefore, the load applied to the cylinder body 3 can be reduced accordingly. As a result, the stress generated at, in particular, the axially intermediate portion of the cylinder body 3 can be reduced, and even in the event that the thickness of the cylinder body 3 is reduced, the durability can be secured.

Incidentally, in the event that only the upper flange portion 3*f* of the cylinder body 3 is connected to the cylinder head 4, an excessive tensile stress is generated at the axially intermediate portion of the cylinder body 3, and in the worst case, there is caused a concern that a crack is generated at the relevant portion. According to the embodiment, however, the generation of such an excessive stress at the intermediate portion of the cylinder body can be avoided due to the existence of the long head bolts 30*c*, thereby making it possible to prevent the generation of such a crack.

In addition, in planting the long head bolts 30*c* in the lower flange portion, since the long head bolt 30*c* is disposed close to the case bolt 30*a* for fastening the crankcase, the long head bolt 30*c* transmits part of the load generated by the combustion pressure to the case side flange portion 3*b*, and furthermore, the case side flange portion 3*b* transmits the load so transmitted thereto to the crankcase 2 via the case bolt 30*a*, whereby the load applied to the cylinder body 3 can be reduced in an ensured fashion. From this point of view, the durability of the cylinder body 3 against the load can be improved.

In addition, since the long head bolt 30*c* and the case bolt 30*a* are made to overlap each other by the distance which is substantially the same as the thickness of the case side flange portion 3*b* in the axial direction of the cylinder bore, the long head bolt 30*c* can ensure the transmission of part of the load generated by the combustion pressure to the case side flange portion 3*b*, thereby making it possible to reduce the load applied to the intermediate portion of the cylinder body 3.

Figure 7:
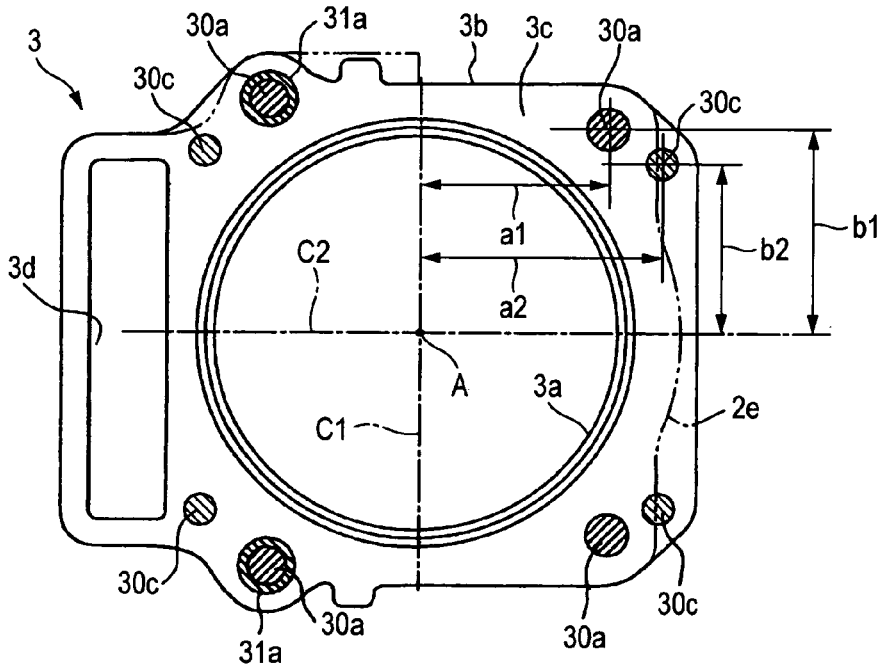
FIG. 7 is a bottom view of a cylinder body of the engine.
Figure 8:
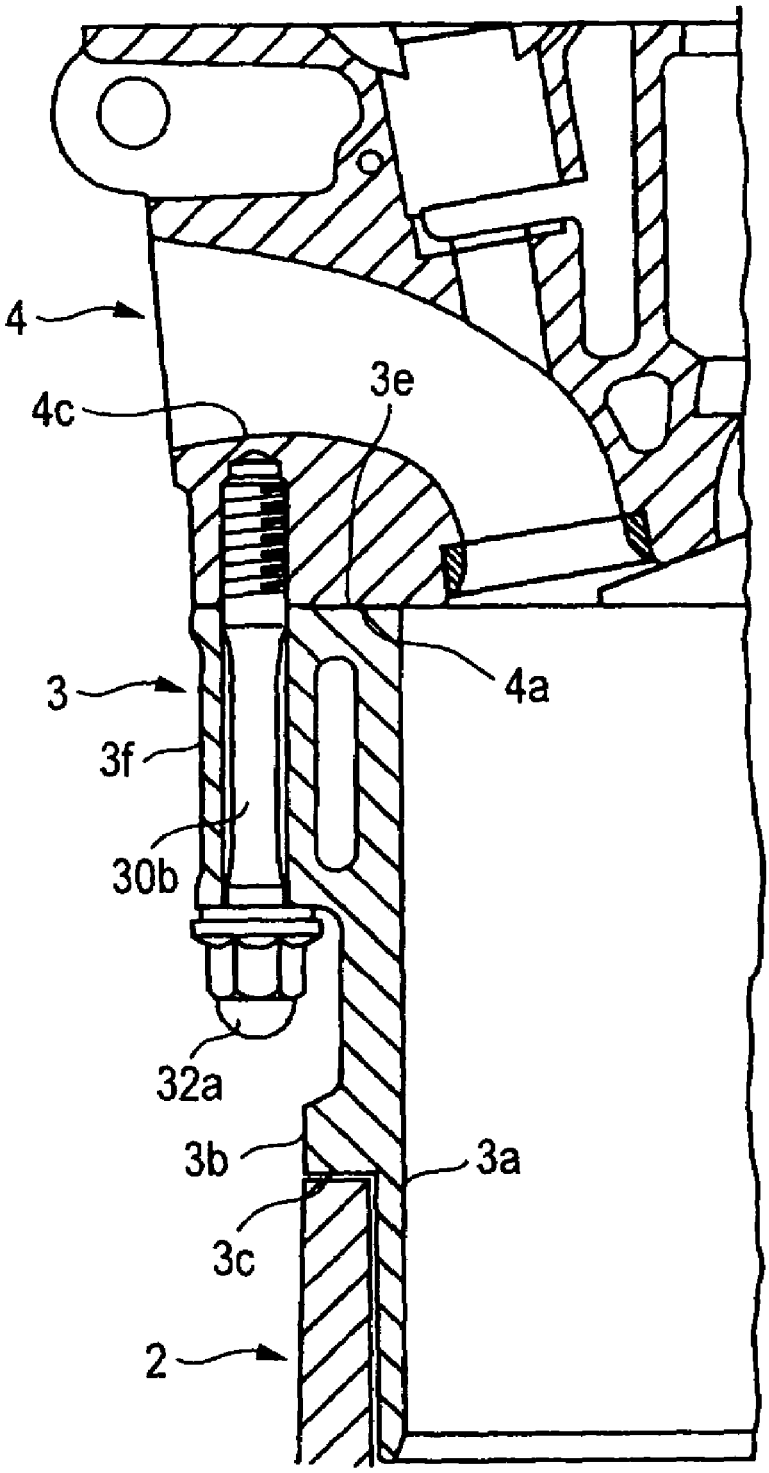
FIG. 8 is a sectional side view showing a portion where the cylinder head of the engine is connected to the cylinder body.
Figure 9:
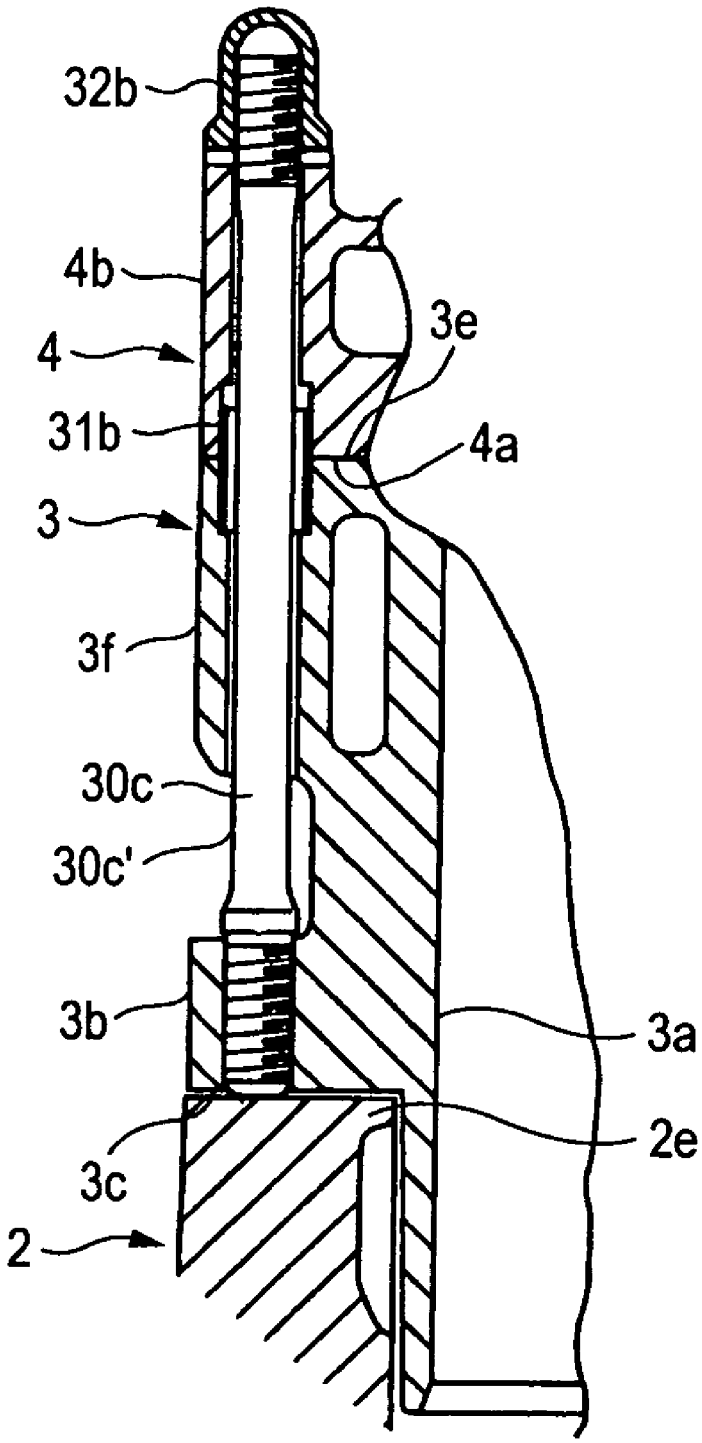
FIG. 9 is a sectional side view showing a portion where the cylinder body of the engine is connected to the crankcase.
Figure 10:
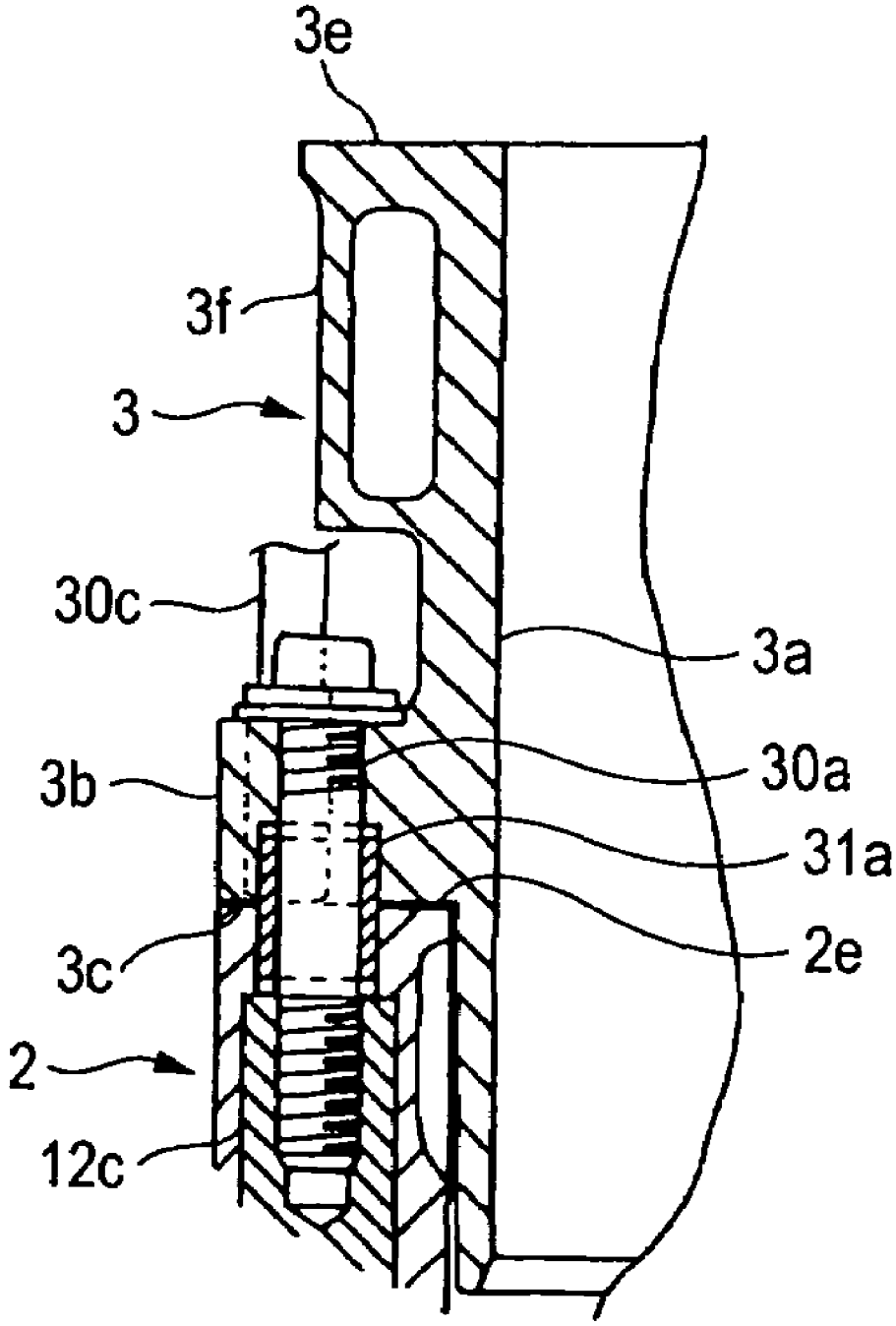
FIG. 10 is another sectional side view showing a portion where the cylinder body of the engine is connected to the crankcase.

Additionally, since the case bolt 30*a* is disposed such that the distance a1 to the first straight line C1 which passes through the axis of the cylinder bore and which is normal to the crankshaft becomes shorter than the distance from the long cylinder bolt 30*c* to the first straight line C1 or such that the case bolt 30*a* is situated closer to the center of the cylinder bore in the direction of the crankshaft, when viewed in the direction of the axis A of the cylinder bore, as shown in double-dashed lines in FIG. 7, the dimension of the mating surface 2*e* of the crankcase 2 that is attached to the cylinder body in the crankshaft direction can be reduced to the vicinity of positions where the long head bolts 30*c* are disposed, and as a result, the dimension of the crankcase 2 in the crankshaft direction can be reduced.

Furthermore, since the construction is adopted in which the long head bolts 30*c* are screwed into the case side flange portion 3*b* of the cylinder body 3 or the long head bolts 30*c* are not screwed into the mating surface 2*e* of the crankcase 2 which is attached to the cylinder body, there is no risk of causing a problem that the long head bolts 30*c* interfere with the web 8*b* of the crankshaft 8, and the long head bolt 30*c* can be disposed such that the distance b2 to the second straight line C2 which passes through the center of the cylinder and which is parallel to the crankshaft becomes shorter than the distance b1 from the case bolt 30*a* to the second straight line C2 or such that the long head bolt 30*c* is situated closer to the crankshaft side, thereby making it possible to reduce the dimension of the cylinder head 4 and the cylinder body 3 in the direction normal to the crankshaft.

In addition, since the axial part 30*c*' of the long head bolt 30*c* is exposed to the outside from the side wall of the cylinder body 3, the wall which surrounds the long head bolt 30*c* can be reduced, and hence the weight of the cylinder body can be reduced accordingly.

Additionally, since the three head bolts are disposed on either side of the cylinder bore across the second straight line C2, while the head bolt 30*b* situated centrally along the direction of the second straight line C2 is situated apart from the axis A of the cylinder bore in the direction normal to the crankshaft, the case side flange portion 3*b* can be minimized with respect to a portion corresponding to the central head bolt 30*b* due to the head bolt 30*b* being set to have the length that does not reach the case side flange portion 3*b*, thereby making it possible to avoid the enlargement of the crankcase.

In addition, since the long head bolts 30*c* are disposed between the cylinder bore 3*a* and the chain compartment 3*d* formed on the side to the cylinder bore 3*a*, the long head bolts 30*c* can be disposed by making an effective use of a dead space formed therebtween.

Furthermore, since the long head bolt 30*c* is screwed into the case side flange portion 3*b* at the one end and is fastened and fixed to the cylinder head with the cap nut 32*b* at the other end thereof, the cylinder head can be removed without securing a large space above the cylinder head, thereby making it possible to secure the maintenance properties of the engine.

Figure 5:
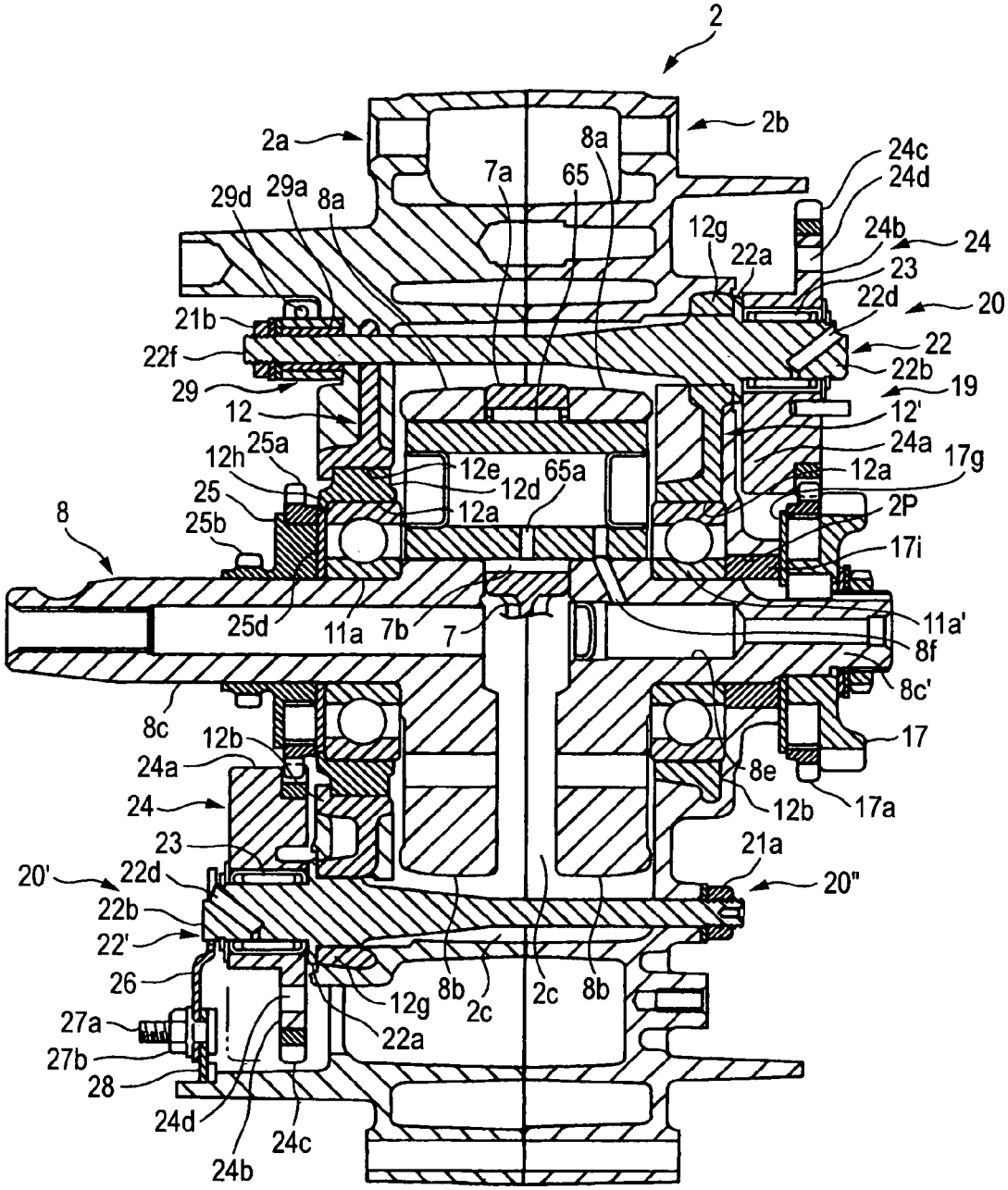
FIG. 5 is a sectional plan view showing a development of a balance shaft of the engine.
Figure 6:
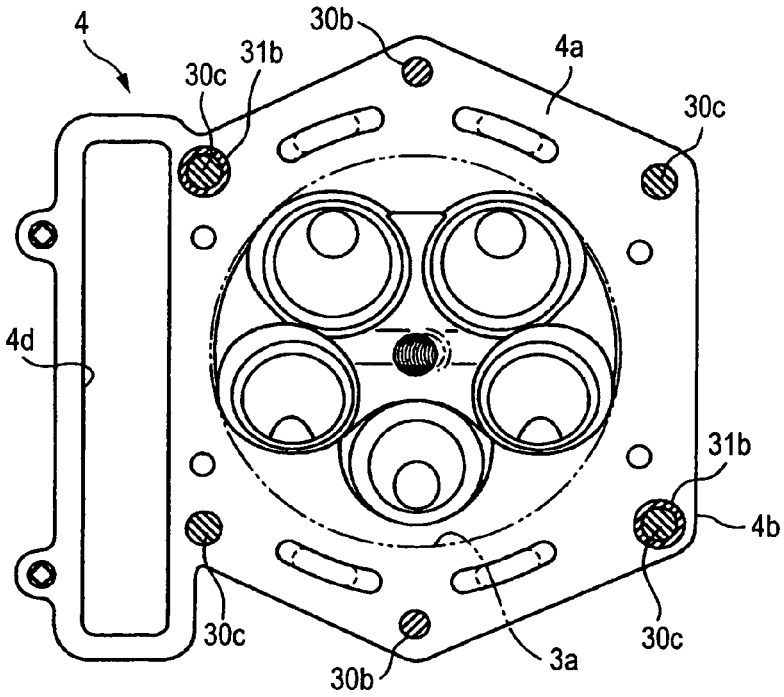
FIG. 6 is a bottom view of a cylinder head of the engine.
Figure 16:
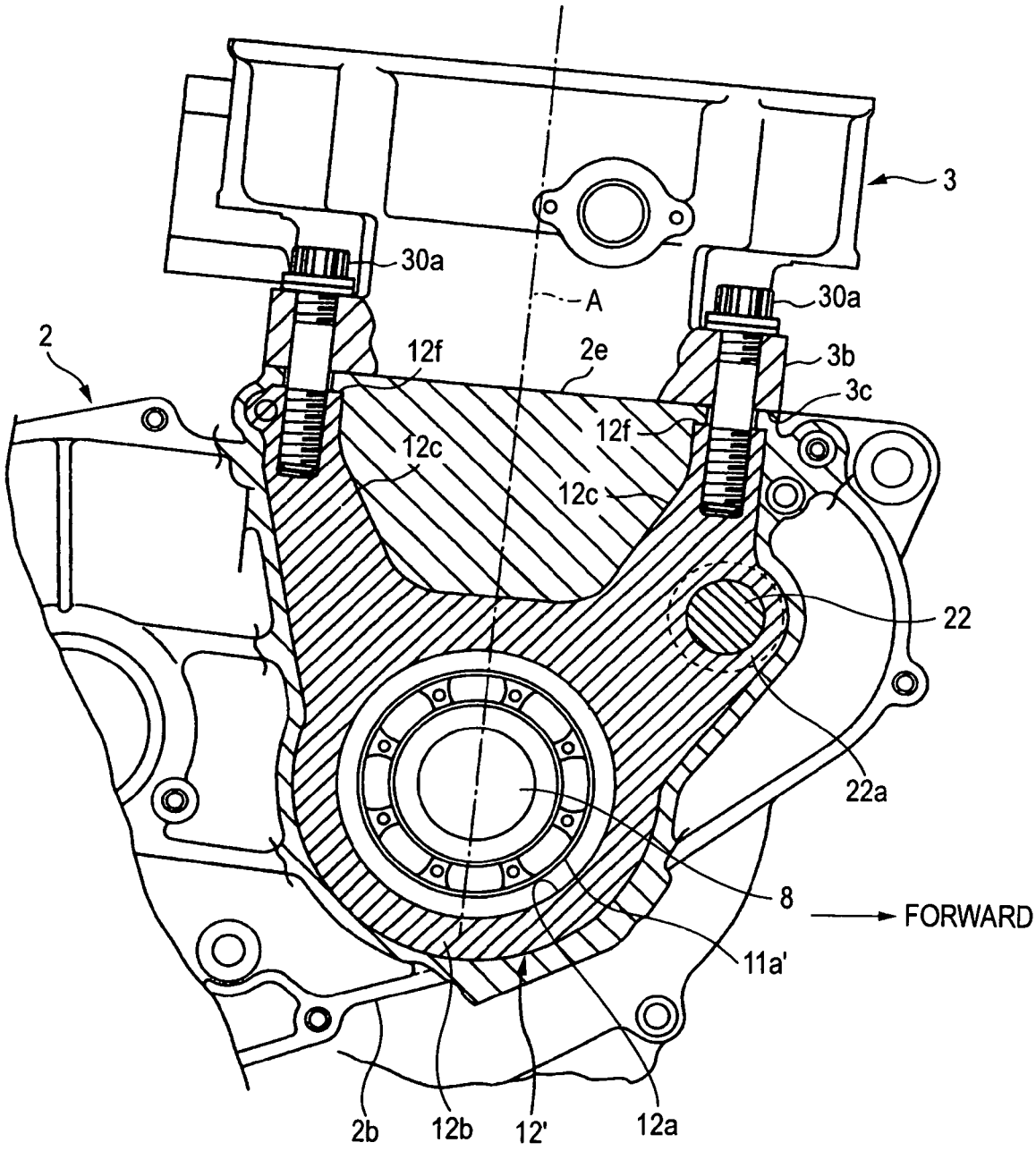
FIG. 16 is a sectional right-hand side view of a bearing bracket of the engine.

Here, as shown in FIGS. 5, 16, the right-side bearing bracket 12' has a boss portion 12*b* in which a right-side bearing 11*a*' of the crankshaft 8 is inserted to be fitted in a bearing hole 12*a* through press fit. Then, the bolt connecting portions 12*c*, 12*c* extend upwardly from front and rear portions of the boss portion 12*b* which are situated opposite to each other across the crankshaft 8 as viewed in the direction in which the crankshaft 8 extends to the vicinity of the cylinder-side mating surface 2*e* of the crankcase 2.

Figure 17:
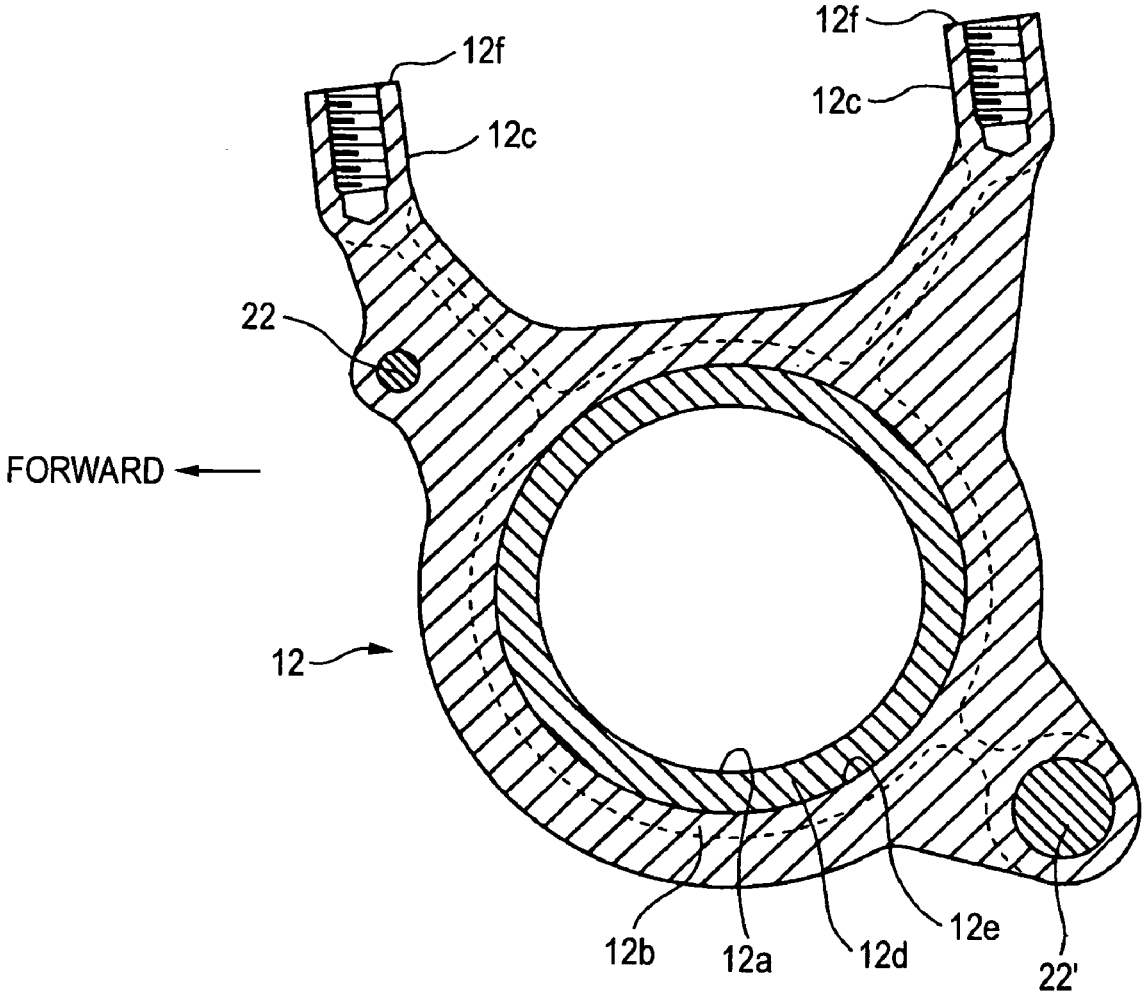
FIG. 17 is a sectional left-hand side view of a bearing bracket.
Figure 18:
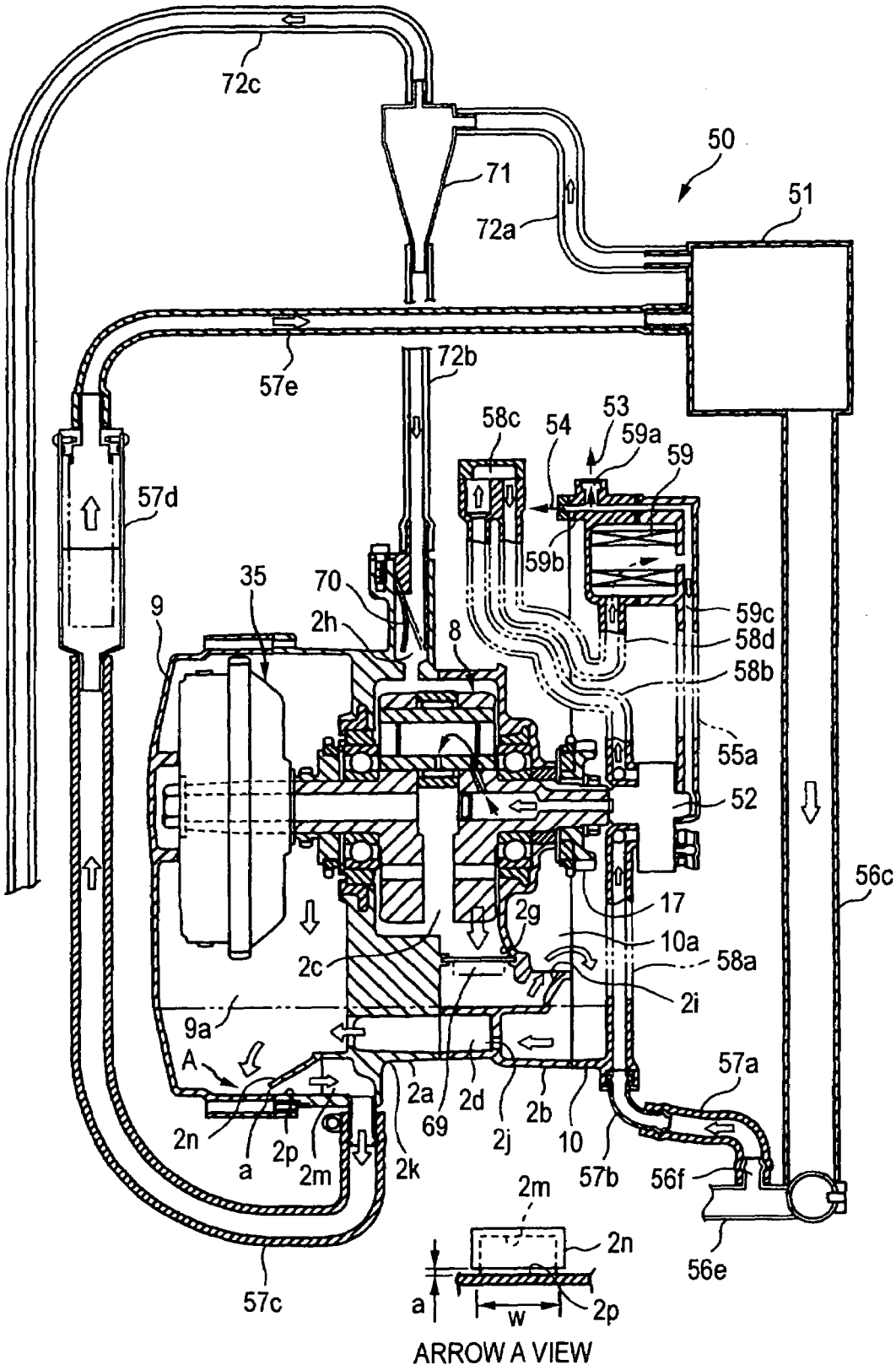
FIG. 18 is an explanatory drawing showing the construction of a lubrication system of the engine.
Figure 19:
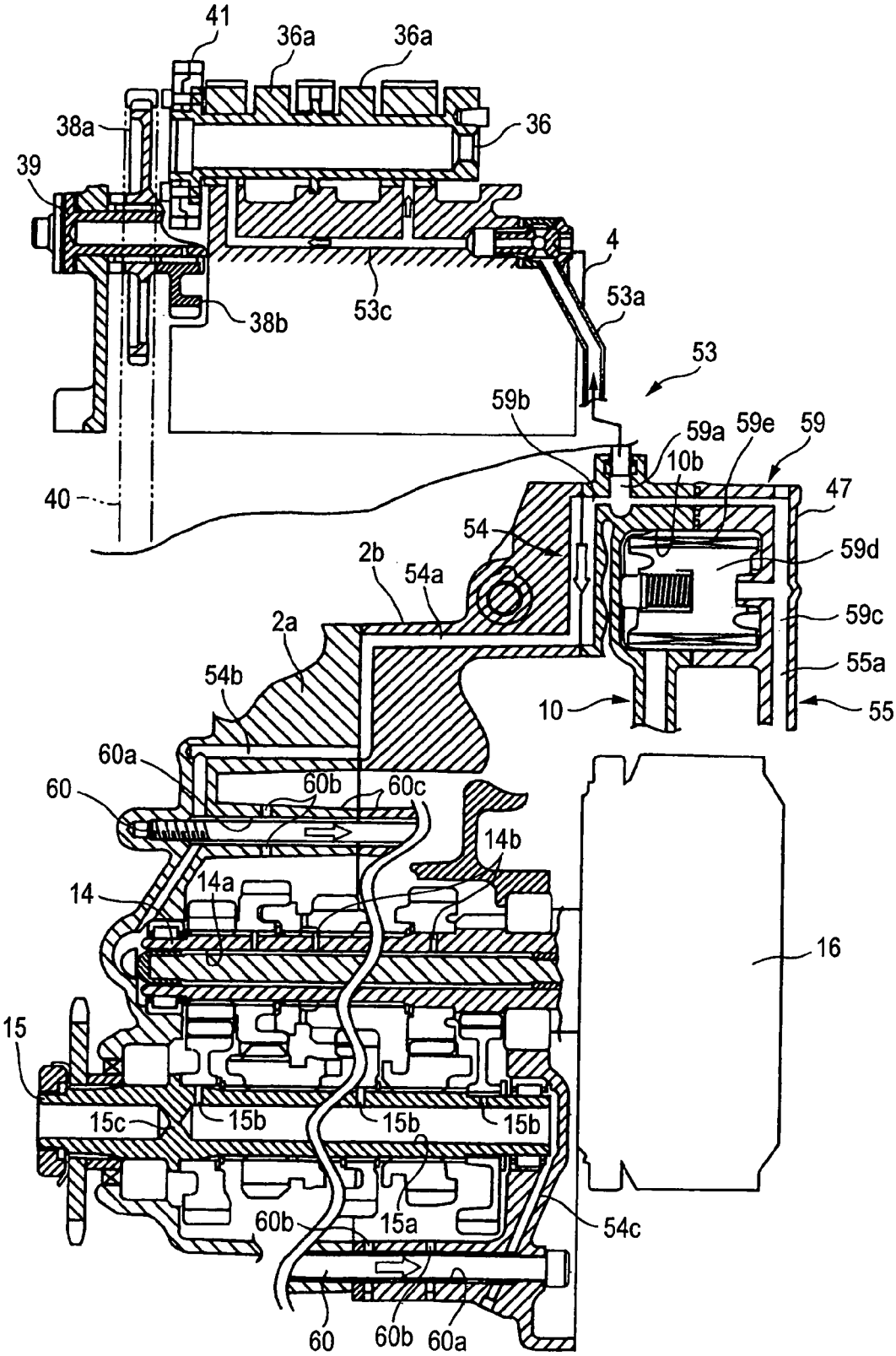
FIG. 19 is a drawing showing the construction of the lubrication system.
Figure 20:
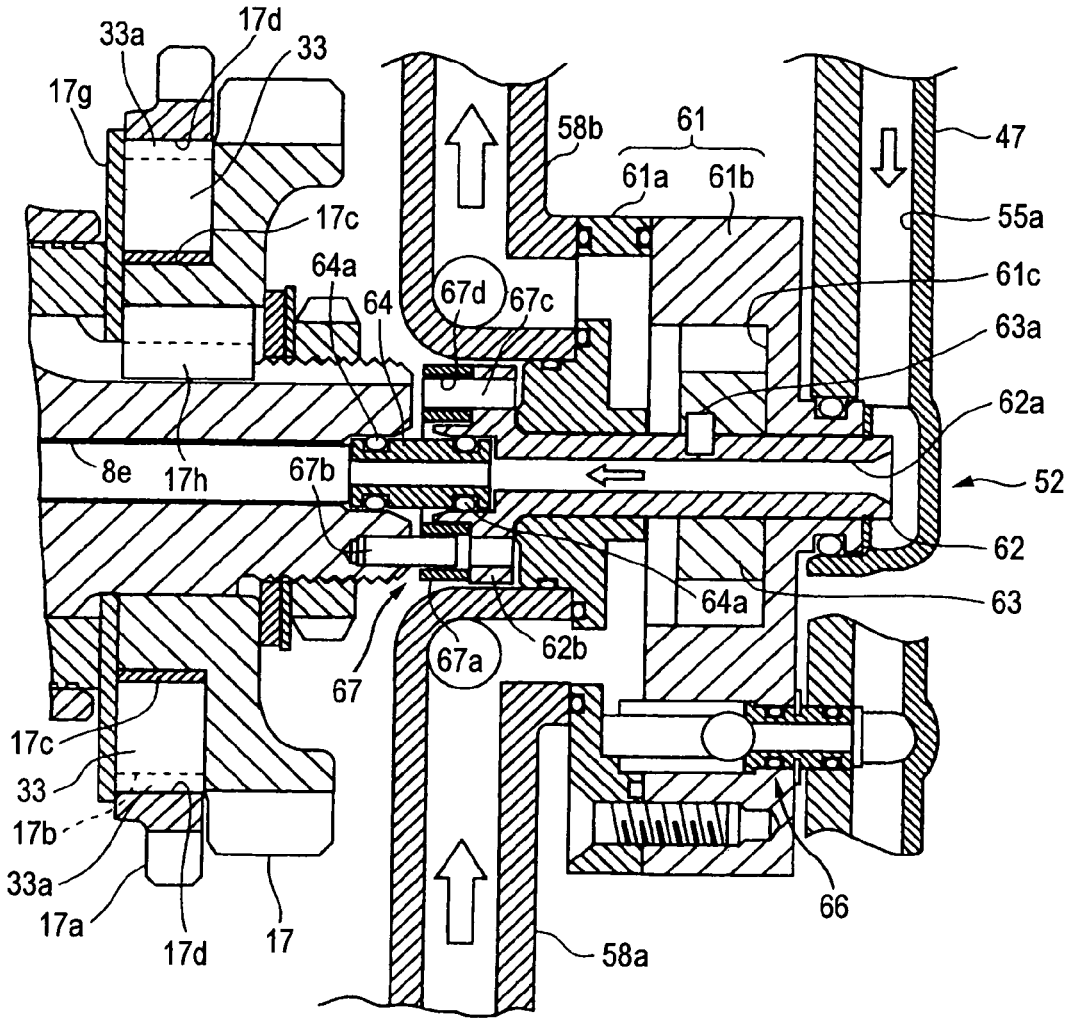
FIG. 20 is a sectional side view of an area surrounding a lubricating oil pump of the lubrication system.
Figure 21:
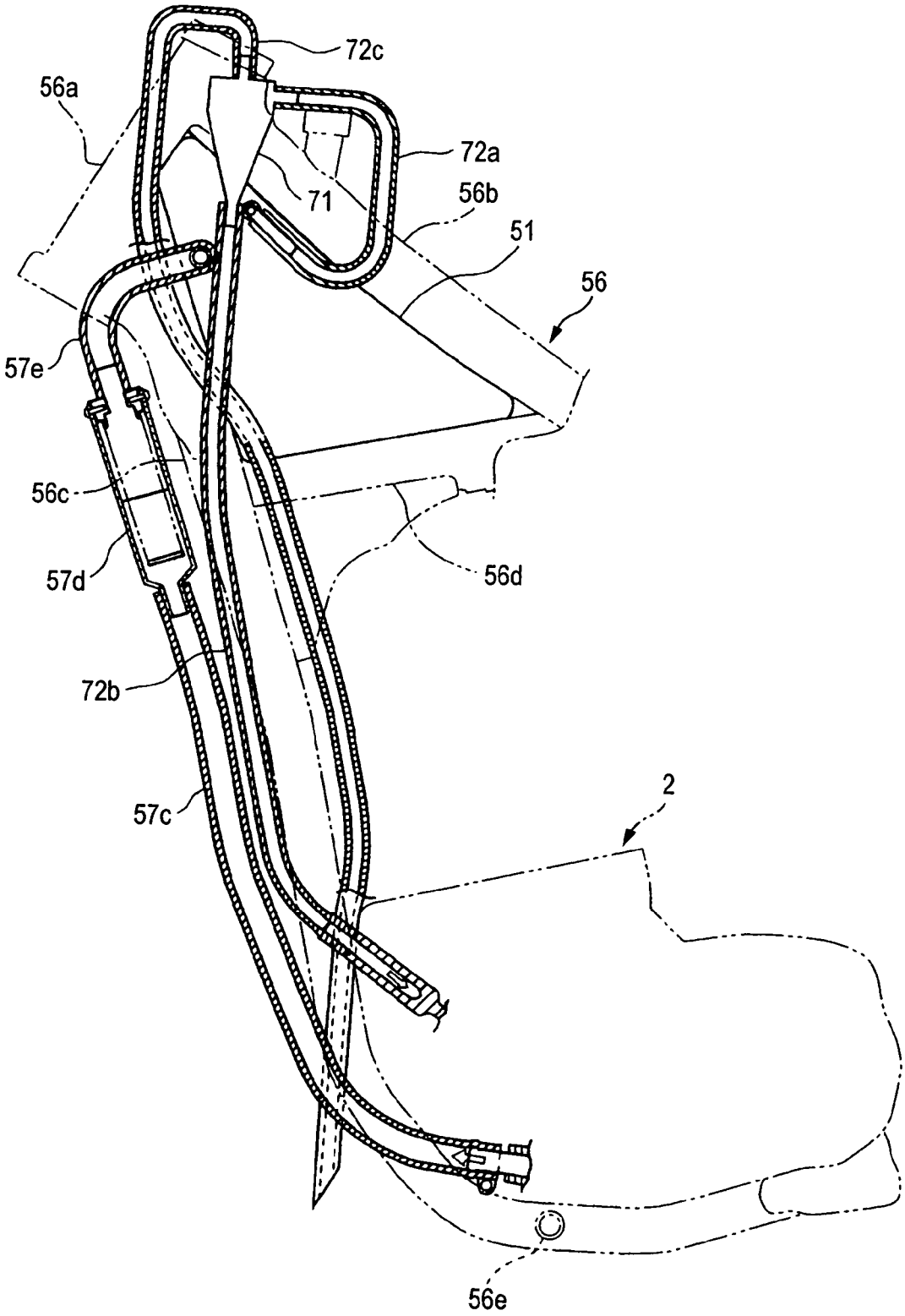
FIG. 21 is a sectional left-hand side view of the lubrication system.

In addition, in the left-side bearing bracket 12, as shown in FIGS. 5, 17, the bolt connecting portions 12*c*, 12*c* extend upwardly from front and rear portions which are situated opposite to each other across the crankshaft 8 as viewed in the direction in which the crankshaft 8 extends to the vicinity of the cylinder-side mating surface 2*e* of the crankcase 2. In addition, a collar hole 12*e* is formed in the boss portion 12*b* into which an iron bearing collar 12*d* having an outside diameter larger than the that of a balancer driving gear 25*a*, which will be described later on, is press fitted. Then, a left-side crankshaft bearing 11*a* is inserted to be fitted in the bearing hole 12*a* of the bearing collar 12*d*.

Here, the bearing collar 12*d* is such as to facilitate the assembly of the crankshaft 8 in the crankcase 2 with a gear unit 25 having the balancer driving gear 25*a* being press fitted on the crankshaft 8.

In addition, as shown in FIG. 5, a seal plate 25*d* is interposed between the gear unit 25 on a left shaft portion 8*c* of the crankshaft 8 and the bearing 11*a*. An inside diameter side portion of the seal plate 25*d* is held by the gear unit 25 and an inner race of the bearing 11*a*, and a slight gap is provided between an outside diameter side portion thereof and an outer race of the bearing 11*a* for avoiding the interference therebetween. In addition, an outer circumferential surface of the seal plate 25*d* is brought into sliding contact with an inner circumferential surface of a flange portion 12*h* of the bearing collar 12*d*.

Furthermore, a seal tube 17*i* is interposed between the bearing 11*a*' of a right shaft portion 8*c*' of the crankshaft 8 and a cover plate 17*g*. An inner circumferential surface of the seal tube 17*i* is fixedly fitted on the right shaft portion 8*c*'. In addition, a seal groove having a labyrinth construction is formed in an outer circumferential surface of the seal tube 17*i*, and the outer circumferential surface of the seal tube 17*i* is brought into sliding contact with an inner circumferential surface of a seal hole 2*p* formed in the right case portion 2*b*.

Thus, the leakage of pressure within a crank compartment 2*c* is prevented by interposing the seal plate 25*d* and the seal tube 17*i* on the outside of the bearings 11*a*, 11*a*' of the left and right shaft portions 8*c*, 8*c*' of the crankshaft 8.

Thus, according to the embodiment, since the bolt connecting portions (the connecting boss portions) 12*c*, 12*c* which extend toward the cylinder body 3 side are integrally formed on the sides situated opposite to each other across the axis A of the cylinder bore of each of the iron alloy crankshaft supporting bearing members 12, 12' which are insert cast in the aluminum alloy crankcase 2 and the case bolts 30*a* for connecting the cylinder body 3 to the crankcase 2 are screwed into the bolt connecting portions 12*c*, respectively, the load generated by virtue of the combustion pressure can be borne uniformly by the two front and rear bolt connecting portions 12*c* which are situated opposite to each other across the axis A of the cylinder bore, whereby the connecting rigidity between the cylinder body 3 and the crankcase 2 can be improved.

In addition, since the balance shafts 22, 22' which are disposed in parallel with the crankshaft 8 in the vicinity of thereof are supported by the iron alloy bearing members 12, 12' at at least one ends thereof, the supporting rigidity of the balance shafts 22, 22' can be enhanced.

Furthermore, in embedding the iron alloy bearing brackets 12, 12' in the aluminum alloy crankcase 2, since the upper end face 12*f* of the bolt connecting portion 12*c* is positioned inwardly without being exposed to the cylinder side mating surface 2*e* of the crankcase 2, there is no risk that metallic members which are different in hardness and material exist in a mixed fashion at a joint between the crankcase 2 and the cylinder block 3, thereby making it possible to avoid a reduction in sealing properties. Namely, in the event that the upper end face 12*f* of the bolt connecting portion 12*c* is made to abut with a case side mating surface 3*c* formed on the lower flange 3*b* of the aluminum alloy cylinder body 3, the sealing properties are reduced due to a difference in thermal expansion coefficients.

In addition, in the left-side bearing bracket 12, since the bearing collar 12 having the outside diameter larger than that of the balancer driving gear 25*a* is attached to the outer circumference of the bearing 11*a*, when assembling the crankshaft 8 in the crankcase 2 with the balancer driving gear 25*a* with the balancer driving gear 25*a* being attached to be fixed onto the crankshaft 8 through press fit or the like (or the balancer driving gear 25*a* may of course be integrally formed on the crankshaft 8), there is caused no risk that the balancer driving gear 25*a* is brought into interference with a minimum inside diameter portion of the boss portion 12*b* of the bearing bracket 12, and hence, the assembling of the crankshaft 8 can be implemented without any problem.

The crankcase 2 is a two-piece type in which the crankcase 2 is divided into the left and right case portions 2*a*, 2*b*. A left case cover 9 is detachably attached to the left case portion 2*a*, and a space surrounded by the left case portion 2*a* and the left case cover 9 constitutes a flywheel magnet compartment 9*a*. A flywheel magnetic generator 35 attached to the left and portion of the crankshaft 8 is accommodated in this flywheel magnet compartment 9*a*. Note that the flywheel magnet compartment 9*a* communicates with a camshaft arranging compartment via the chain compartments 3*d*, 4*d*, which will be described later on, whereby most of the lubricating oil which has been used to lubricate the camshafts falls into the flywheel magnet compartment 9*a* via the chain compartments 3*d*, 4*d*.

In addition, a right case cover 10 is detachably attached to the right case portion 2*b*, and a space surrounded by the right case portion 2*b* and the right case cover 10 constitutes a clutch compartment 10*a*.

The crank compartment 2*c* and a transmission compartment 2*d* are formed at front and rear portions of the crankcase 2, respectively. The crank compartment 2*c* is made to open to the cylinder bore 3*a* but is defined substantially to be separated from the other compartments such as the transmission compartment 2*d*. Due to this, the pressure within the transmission compartment 2*d* is caused to fluctuate as the piston reciprocates vertically, thereby allowing the transmission compartment 2*d* to function as a pump.

A transmission 13 is accommodated and arranged in the transmission compartment 2*d*. The transmission 13 is such as to have a constant mesh construction in which a main shaft 14 and a drive shaft 15 are provided and arranged in parallel with the crankshaft 8, and first-speed to fifth-speed gears 1*p* to 5*p* attached to the main shaft 14 are made to constantly mesh with first-speed to fifth-speed gears 1*w* to 5*w* attached to the drive shaft 15.

The main shaft 14 is rotationally supported by the left and right case portions 2*a*, 2*b* via main shaft bearings 11*b*, 11*b*, whereas the drive shaft 15 is rotationally supported by the left and right case portions 2*a*, 2*b* via drive shaft bearings 11*c*, 11*c*.

A right end portion of the main shaft 14 passes through the right case portion 2*b* and protrudes to the right side, and a clutch mechanism 16 is attached to the protruding portion, and this clutch mechanism 16 is located within the clutch compartment 10*a*. Then, a large reduction gear (an input gear) 16*a* of the clutch mechanism 16 meshes with a small reduction gear 17 fixedly attached to the right end portion of the crankshaft 8.

A left end portion of the drive shaft 15 protrudes outwardly from the left case portion 2*a* and a driving sprocket 18 is attached to the protruding portion. This driving sprocket 18 is connected to a driven sprocket on a rear wheel.

A balancer unit 19 according to the embodiment includes front and rear balancers 20, 20' disposed opposite across the crankshaft 8 and having substantially the same construction. The front and rear balancers 20, 20' include the balance shaft 22, 22' which do not rotate and weights 24, 24 which are rotationally supported on the balance shat via bearings 23, 23.

Here the balance shafts 22, 22' are made to double as the case bolts (the connecting bolts) for fastening and connecting the left and right case portions 2*a*, 2*b* together in the direction of the crankshaft. The respective balance shafts 22, 22' function to connect the left and right case portions 2*a*, 2*b* together by causing flange portions 22*a* formed on insides of the rotationally supported weights 24 in a transverse direction of the engine to abut with boss portions 12*g* integrally formed on the bearing brackets 12, 12' which are insert cast into the left and right case portions 2*a*, 2*b* and screwing fixing nuts 21*b*, 21*a* on opposite end portions of the respective balance shafts 22, 22'.

The weight 24 includes a semi-circular weight main body 24*a* and a circular gear supporting portion 24*b* which is integrally formed on the weight main body, and a ring-shaped balancer driven gear 24*c* is fixedly attached to the gear supporting portion 24*b*. Note that reference numeral 24*b* denotes a hole made in a part of the weight 24 which is situated opposite to the weight main body 24*a* so as to reduce the weight of the part to as low a level as possible.

The balancer driven gear 24*c* attached to the rear balancer 20' meshes with the balancer driving gear 25*a* which is rotationally attached relative to the gear unit 25 which is securely attached to the left shaft portion 8*c* of the crankcase 8 through press fit.

Figure 11:
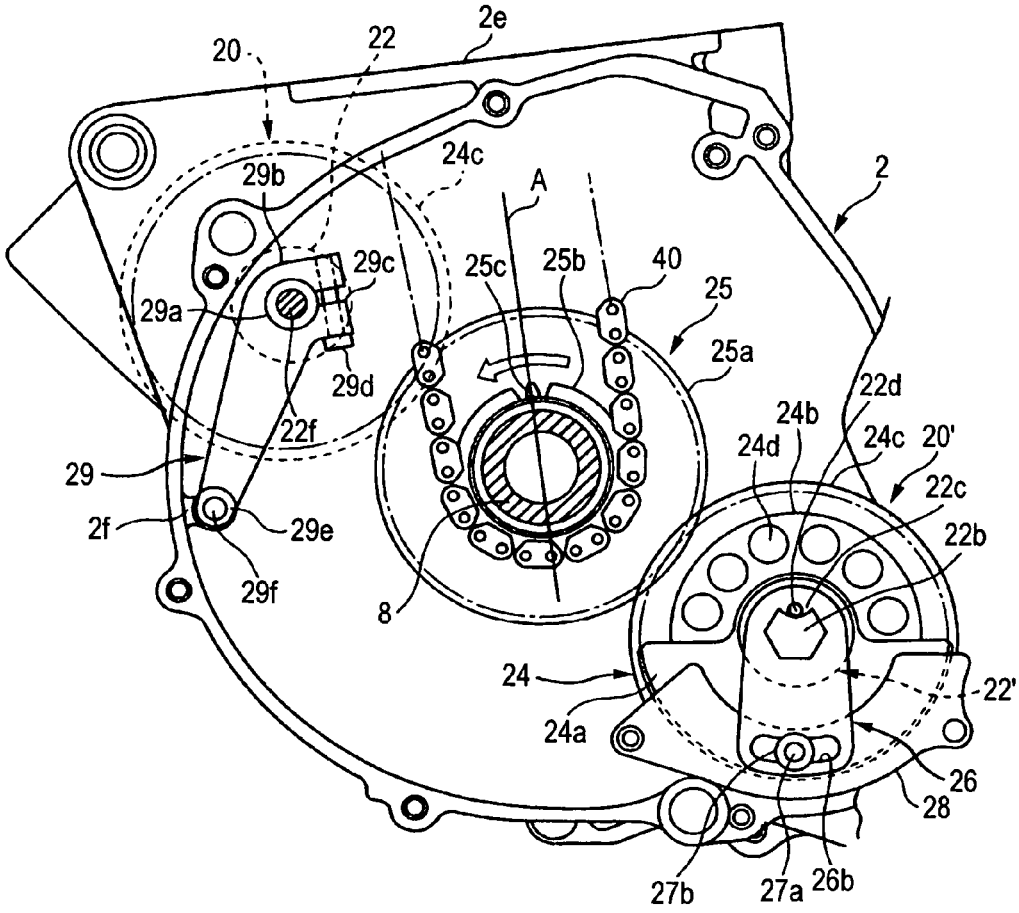
FIG. 11 is a left-hand side view showing a balancer unit of the engine.

Note that reference numeral 25*b* denotes a timing chain driving sprocket integrally formed on the gear unit 15 and has, as shown in FIG. 11, an aligning or timing mark 25*c* for alignment of timing marks for valve timing. The gear unit 25 is press fitted on the crankshaft 8 such that the timing mark 25*c* aligns with the cylinder bore axis A as viewed in the direction in which the crankshaft extends when the crankshaft 8 is situated at a top dead center of a compression stroke.

In addition, the balancer driven gear 24*c* attached to the front balancer 20 meshes with a balancer driving gear 17*a* which is supported rotationally relative to the small reduction gear 17 which is fixedly attached to the right shaft portion 8*c'* of the crankshaft 8.

Here, the rear balancer driving gear 25*a* is supported rotationally relative to the gear unit 25, and the front balancer driving gear 17*a* is supported rotationally relative to the small reduction gear 17. Then, U-shaped damper springs 33 each made up of a plate spring are interposed between the balancer driving gears 25*a*, 17*a* and the gear unit 25 and the small reduction gear 17, respectively, to thereby restrain the transmission of impact generated due to a torque fluctuation occurring in the engine to the balancers 20, 20' is restrained from being transmitted.

Figure 14:
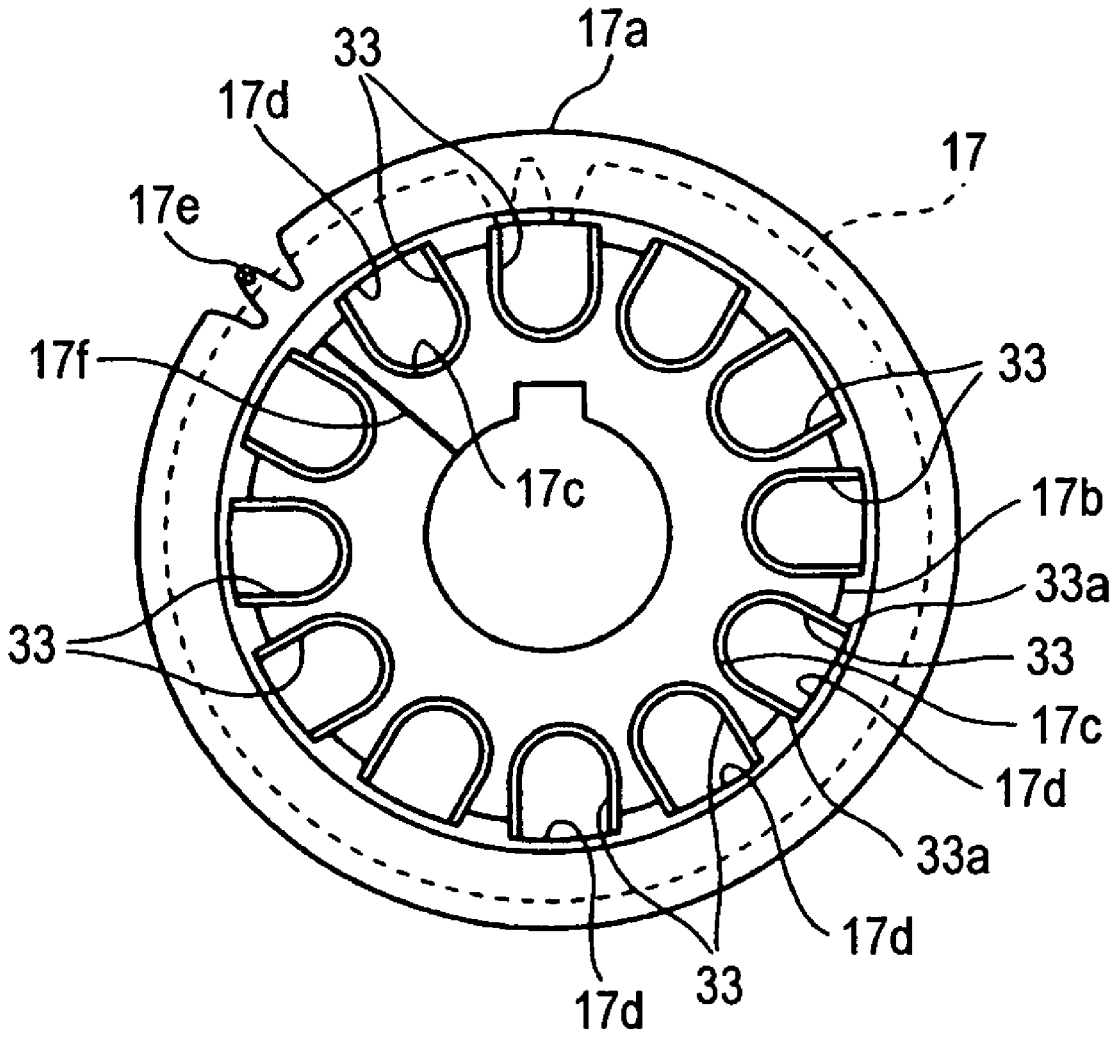
FIG. 14 is a side view showing a damping construction of a balancer drive gear of the balancer unit.
Figure 15:
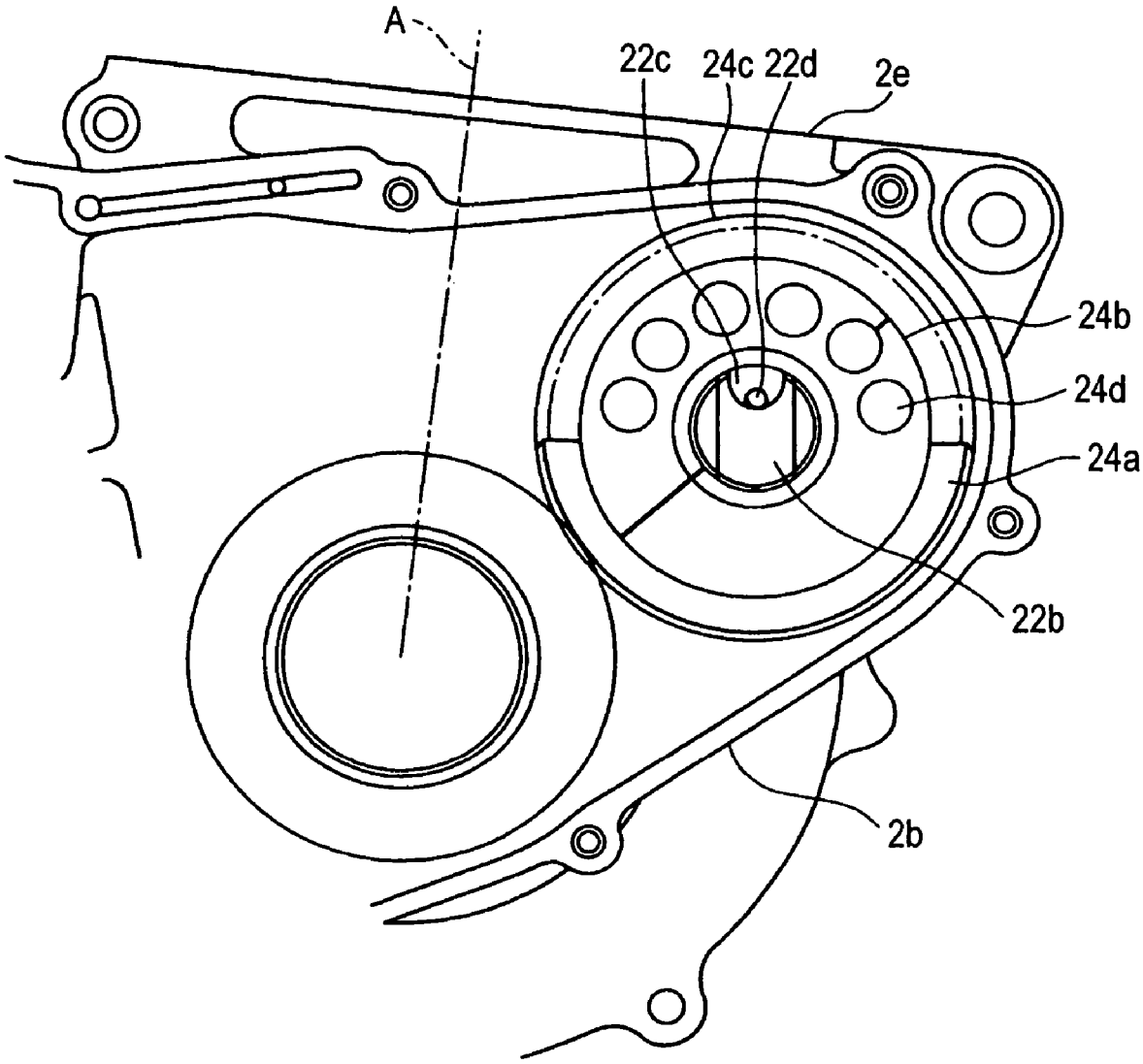
FIG. 15 is a right-hand side view of the balancer unit.

Here, while the balancer driving gear 17*a* for driving the front balancer 20 will be described in detail by reference to FIG. 14, the same description would be given if the balancer driving gear 25*a* for driving the rear balancer were described. The balancer driving gear 17*a* is formed into a ring shape and is supported by a sliding surface 17*b* formed so as to have a smaller diameter than the small reduction gear 17 rotationally relative to a side of the small reduction gear 17. Then, a number of U-shaped spring retaining grooves 17*c* are formed in the sliding surface 17*b* by setting them back into the surface thereof in a radial fashion about the center of the crankshaft, and the U-shaped damper springs 33 are arranged to be inserted in place within the spring retaining grooves 17*c*. Opening side end portions 33*a*, 33*a* of the damper spring 33 are locked at front and rear stepped portions formed in a locking recessed portion 17*d* formed in an inner circumferential surface of the balancer driving gear 17*a*.

When a relative rotation is generated between the small reduction gear 17 and the balancer driving gear 17*a* due to a torque fluctuation, the damper springs 33 resiliently deform in a direction in which the space between the end portions 33*a*, 33*a* narrows so as to absorb the torque fluctuation so generated. Note that reference numeral 17*g* denotes a cover plate for retaining the damper springs 33 within the retaining grooves 17*c*, reference numeral 17*h* denotes a key for connecting the small reduction gear 1 with the crankshaft 8, and reference numerals 17*e*, 17*f* denote, respectively, alignment marks for use in assembling the small reduction gear 17 and the balancer driving gear 17*a*.

A mechanism for adjusting a backlash between the balancer driven gears 24*c*, 24*c* and the balancer driving gears 25*a*, 17*a* is provided on the balancers 20, 20'. This adjusting mechanism is constructed such that the balancer axis of the balance shaft 22, 22' slightly deviates from the rotational center of the balancer driven gear 24*c*. Namely, when the balance shaft 22, 22' is made to rotate about the balancer axis, the space between the rotational center line of the balancer driven gear 24*c* and the rotational center line of the balancer driving gear 25*a*, 17*a* changes slightly, whereby the backlash is changed.

Here, a mechanism for rotating the balance shaft 22, 22' differs between the front balancer 20 and the rear balancer 20'. Firstly, in the rear balancer 20', a hexagonal locking protruding portion 22*b* is formed on a left end portion of the rear balance shaft 22', and a spline-like (apolygonal star-like) locking hole 26*a* formed in one end of a rotational lever 26 is locked on the locking protruding portion 22*b*. In addition, an arc-like bolt hole 26*b* is formed in the other end portion of the rotational lever 26 in such a manner as to extend about the balancer axis.

A fixing bolt 27*a* passed through the bolt hole 26*b* is planted in a guide plate 28. The guide plate 28 is generally formed into an arc-like shape and is fixedly bolted to the crankcase 2. Note that the guide plate 28 has also a function to control the flow of lubricating oil.

The adjustment of the backlash of the rear balancer 20' is implemented by rotating the rotational lever 26 so as to bring the backlash to an appropriate state with the fixing nut 21*a* being loosened and thereafter by fixing the rotational lever 26 with the fixing bolt 27*a* and a fixing nut 27*b*, and thereafter, the fixing nut 21*a* is refastened.

Figure 12:
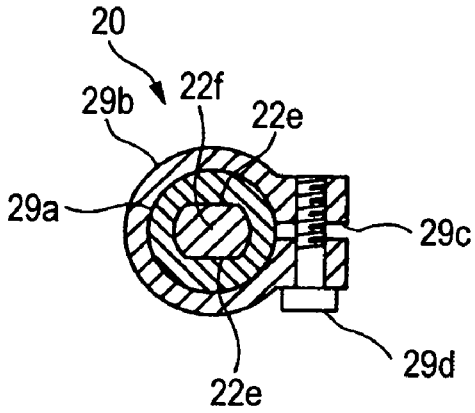
FIG. 12 is an enlarged cross-sectional view of a portion where a holding lever of the balancer unit is attached.
Figure 13:
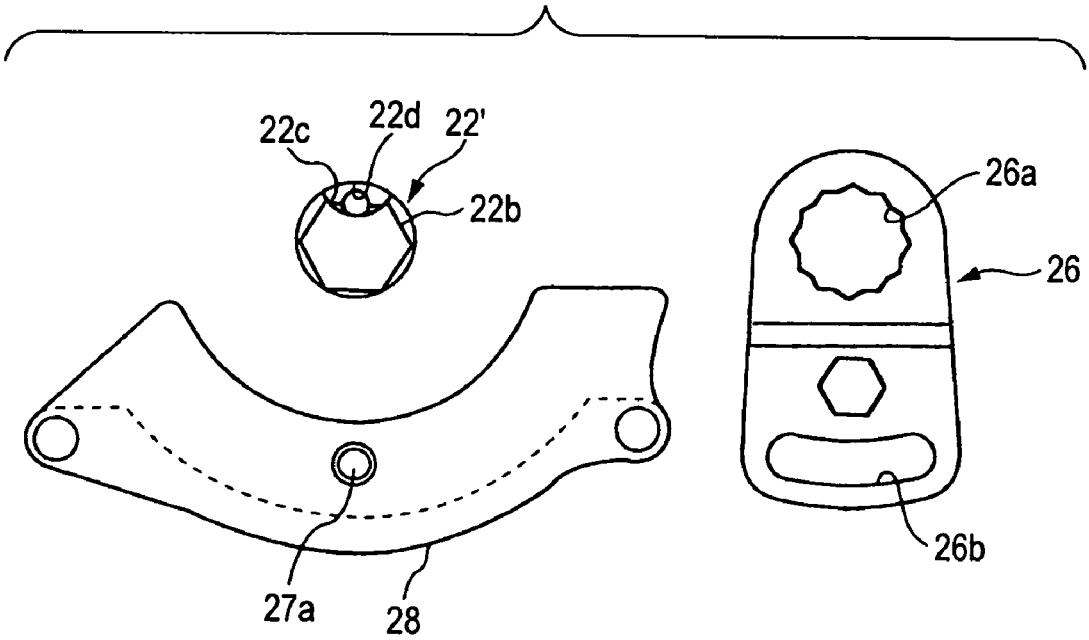
FIG. 13 is a side view of constituent components of a rotational lever of the balancer unit.

A grip portion 22*f* having an oval cross section, which is formed by forming a flat portion 22*e* on both sides of a cross-sectionally circular shape, is formed on a left end portion of the front balance shaft 22 (refer to FIG. 12). A collar 29*a* having an inner circumferential shape which matches an outer circumferential shape of the grip portion 22*f* is attached to the grip portion 22*f*, and furthermore, a holding portion 29*b* of a holding lever 29 is attached to an outside of the collar 29*a* in such a manner as to move axially but as not to rotate relatively. A distal end portion 29*e* of the holding lever 29 is fixed to a boss portion 2*f* of the left case portion 2*a* with a bolt 29*f*. In addition, a tightening slit 29*c* is formed in the holding portion 29*b* of the holding lever 29, so that the rotation of the collar 29 and hence of the balance shaft 22 is prevented by tightening up the fixing bolt 29*d*. Furthermore, the fixing nut 21*b* is screwed on the balance shaft 22 to an outer side of the collar 29 so as to be secured thereto via washer.

The adjustment of the backlash of the front balancer 20 is implemented by loosening the fixing nut 21*b* or preferably removing the same, griping the grip portion 22*f* of the balance shaft 22 with a tool to rotate the shaft so as to bring the backlash to an appropriate state, and thereafter tightening up the fixing bolt 29*d*, and thereafter, the fixing nut 21*b* is fastened.

In addition, a lubricating oil introducing portion 22*c* is formed in an upper portion of the locking protruding portion 22*b* by cutting out the upper in an arc. A guide bore 22*d* is made to open to the introducing portion 22*c*, and the guide bore extends into the balance shaft 22 and passes therethrough to below an outer circumferential surface of the balance shaft 22, whereby the lubricating oil introducing portion 22*c* is made to communicate with an inner circumferential surface of the balancer bearing 23. Thus, lubricating oil that has fallen in the lubricating oil introducing portion 22*c* is supplied to the balancer bearing 23.

Here, while the weight 24 and the balancer driven gear 24*c* are disposed at the right end portion along the direction in which the crankshaft extends in the front balancer 20, in the rear balancer 20', they are disposed at the left end portion. In addition, the balancer driven gear 24*c* is located rightward relative to the weight 24 in both the front and rear balancers 20, 20', and therefore, the weight 24 and the balancer driven gear 24*c* are set into the same configuration in both the front and rear balancers.

Thus, according to the embodiment, since the weight main body 24*a* and the balancer driven gear 24*c* of the balancer 20 are disposed on the right-hand side (one side) of the front balance shaft (the primary balance shaft) 22 along the direction in which the crankshaft extends and the weight main body 24*a* and the balancer driven gear 24*c* are disposed on the left-hand side (the other side) of the rear balance shaft (the secondary balance shaft) 22' along the direction in which the crankshaft extends, the reduction in balance in weight in the crankshaft direction that would result when providing a two-shaft balancer unit can be avoided.

In addition, since the front and rear balance shafts 22, 22' are made to double as the case bolts for connecting the left and right case portions 2*a*, 2*b* together, when adopting a two-shaft balancer unit, the connecting rigidity of the crankcase can be enhanced while restraining the construction of the engine from becoming complex and the number of components from being increased.

Additionally, since the balancer weight main body 24*a* and the balancer driven gear 24*c* are made integral and are supported rotationally by the balance shafts 22, 22', respectively, only the weight made up of the balancer weight main body 24*a* and the balancer driven gear 24*c* may be driven to rotate, and therefore, the engine output can be attempted to be used effectively to such an extent that the balance shafts themselves do not need to be driven to rotate.

In addition, the degree of freedom in assembling can be improved when compared with an engine construction in which a balancer weight and a balance shaft are made integral.

Additionally, since the rotational center lines of the balancer driven gears 24*c* are caused to deviate relative to the axes of the balance shafts 22, 22', the backlash between the balancer driven gears 24*c* and the balancer driving gears 25*a*, 27*a* on the crankshaft 8 side can be adjusted by the simple construction or only by a simple operation of rotating the balance shafts, thereby making it possible to prevent the generation of noise.

On the front balance shaft 22, the backlash adjustment is implemented by gripping the grip portion 22*f* formed on the left-hand side of the balance shaft 22 with a tool so as to rotate the balance shaft 22, and on the rear balance shaft 22', the backlash adjustment is implemented by rotating the rotational lever 26 provided on the left-hand side of the balance shaft 22'. Thus, on either of the front and rear balance shafts 22, 22', the backlash can be adjusted from the left-hand side of the engine, and hence the backlash adjusting work can be implemented efficiently.

Additionally, since the balancer driving gear 17*a* on the crankshaft 8 side which meshes with the balancer driven gear 24*c* is constructed to be disposed in such a manner as to rotate relatively to the sliding surface 17*b* of the small reduction gear 17 which is fixed to the crankshaft 8 and the U-shaped damper springs 33 are disposed in the spring retaining grooves 17*c* formed by setting them back from the sliding surface 17*b*, the impact generated due to the torque fluctuation in the engine can be absorbed by the compact construction so that the balancer unit can be operated smoothly. Note that the same description can be made with respect to the balancer drive gear 25*a*.

Furthermore, a coolant pump 48 is disposed at the right end portion of the front balance shaft 22 coaxially therewith. A rotating shaft of the coolant pump 48 is connected to the balance shaft 22 by an Oldham's coupling which has a similar construction to that of a lubricating oil pump 52, which will be described later on, in such a manner that a slight deviation between the centers of the rotating shaft and the balance shaft 22 can be absorbed.

In a valve train device of the embodiment, an intake camshaft 36 and an exhaust camshaft 37 which are disposed within the cylinder head cover 5 are constructed to be driven to rotate by the crankshaft 8. To be specific, a crankshaft sprocket 25*b* of the gear unit 25 press fitted on the left shaft portion 8*c* of the crankshaft 8 so as to be attached thereto and an intermediate sprocket 38*a* rotationally supported by a support shaft 39 planted in the cylinder head 4 are connected by a timing chain 40, and an intermediate gear 38 formed integrally on the intermediate sprocket 38*a* and having a smaller diameter than that of the intermediate sprocket 38*a* meshes with intake and exhaust gears 41, 42 secured to end portions of the intake and the exhaust camshafts 36, 37. Note that the timing chain 40 is disposed so as to pass through the chain compartments 3*d*, 4*d* formed on the left walls of the cylinder block 3 and the cylinder head 4.

The intermediate sprocket 38*a* and the intermediate gear 38*b* are rotationally supported by the support shaft 39 which passes through the chain compartment 4*d* on the cylinder head 4 in the direction in which the crankshaft extend along the cylinder bore axis A via two sets of needle bearings 44. The support shaft 39 is fixed at a flange portion 39*a* thereof to the cylinder head 4 with two bolts 39*b*. Note that reference numerals 39*c*, 39*d* denote a sealing gasket, respectively.

Here, commercially available (standard) bearings are adopted for the two sets of needle bearings 44, 44. A space adjusting collar 44*a* is disposed between the respective bearings 44, 44, and thrust washers 44*b*, 44*b* for receiving thrust load are provided at ends of the bearings. The thrust washer 44*b* is formed into a stepped shape having a large diameter portion which is brought into sliding contact with an end face of the intermediate sprocket and a stepped portion which protrudes axially toward the needle bearing 44.

Thus, since the space adjusting collar 44*a* is interposed between the two sets of bearings 44, 44, commercially available standard bearings can be adopted for the needle bearings by adjusting the length of the collar 44*a*, thereby making it possible to reduce costs.

In addition, since the washer having the stepped configuration is adopted as the thrust washer 44*b*, the assembling work of the intermediate sprocket 38*a* can be improved. Namely, in assembling the intermediate sprocket 38*a*, while the support shaft 39 is inserted from the outside in a state in which the intermediate sprocket 38*a* and the intermediate gear 38*b* are disposed within the chain compartment 4*d* with the thrust washers being positioned at the ends of the intermediate sprocket 38*a* and the intermediate gear 38*b* in such a manner as not to fall therefrom, the thrust washer 44*b* can be prevented from falling by allowing the stepped portion of the thrust washer 44*b* to be locked in a shaft hole in the intermediate sprocket 38*a*, and hence the assembling properties can be improved.

In addition, an oil hole 39*e* is formed in the support shaft 39 for supplying lubricating oil introduced from the cam compartment via an oil introducing bore 4*e* formed in the cylinder head 4 to the needle bearing 44.

Additionally, four weight reduction holes 38*c* and two inspection holes 38*c* adapted to be used at the time of assembling and made to double as weight reduction holes are formed at intervals of 60 degrees. Then, an alignment or timing mark 38*d* is stamped on a tooth situated substantially at the center of the inspection hole 38*c*' for the intermediate gear 38*b*, and timing marks 41*a*, 42*a* are also stamped on two teeth of intake and exhaust camshaft gears 41, 42 which correspond to the timing marks 38*d*. Here, when aligning the left and right timing marks 38*d*, 38*d* with the timing marks 41*a*, 42*a*, the intake and exhaust camshafts gears 41, 42 are located at positions, respectively, which correspond to a top dead center of a compression stroke.

Furthermore, timing marks 38*e*, 38*e* are also formed at portions of the intermediate sprocket 38*a* which are situated on a cover side mating surface 4*f* of the cylinder head 4 when the timing marks 38*d* align with 41*a*, 42*a*.

To align valve timings, firstly, the crankshaft 8 is held at a top dead center of a compression stroke by aligning the timing mark 25*c* (refer to FIG. 11) with the cylinder bore axis A. In addition, the intermediate sprocket 38*a* and the intermediate ear 38*b* which are attached to the cylinder head 4 via the support shaft 39 are positioned so that the timing mark 38*e* of the intermediate sprocket 38*a* aligns with the cover side mating surface 4*f*, and in this state, the crankshaft sprocket 25*b* and the intermediate sprocket 38*a* are connected by the timing chain 40. Then, the intake and exhaust camshaft gears 41, 42 on the intake and exhaust camshafts 36, 37 are brought into mesh engagement with the intermediate gear 38*b* while confirming through the inspection hole 38*c*' that the timing marks 41*a*, 42*a* align with the timing mark 38*d* on the intermediate gear 38*b*, and the intake and exhaust camshafts 36, 37 are fixed to an upper surface of the cylinder head 4 via cam carriers.

Thus, since the inspection holes 38*c*' made to double as the weight reduction holes to reduce the weight of the large diameter intermediate sprocket 38*a* are provided in the intermediate sprocket 38*a*, so that the alignment of the timing marks 38*d* on the small diameter intermediate gear 38*b* which is set on the back of the intermediate sprocket 38*a* with the timing marks 41*a*, 42*a* on the camshaft gears 4l, 42 can be confirmed through the inspection holes 38*c*', the meshing positions of the intermediate gear 38*b* with the camshaft gears 41, 42 can visually confirmed in an easy and ensured fashion while the small diameter intermediate gear 38*b* is placed on the back of the large diameter intermediate sprocket 38*a*, thereby making it possible to align the valve timings without any problem.

In addition, since the intermediate gear 38*b* can be disposed on the back side of the intermediate sprocket 38*a*, the dimension from the camshaft gears 41, 42 which mesh with the intermediate gear 38*b* to a cam nose 36*a* can be made shorter, whereby the torsional angle of the camshaft can be made smaller to such an extent that the dimension is made so shorter, thereby making it possible to make compact an area surrounding the camshafts.

Namely, for example, in a case where the intermediate gear 38*b* is disposed on a front side of the intermediate sprocket 38*a*, while the valve timings can easily be aligned, the dimension from the camshaft gears 41, 42 to the cam nose becomes long, and the torsional angle of the camshafts becomes large to such an extent that the dimension is extended, thereby reducing the control accuracy of valve opening and closing timings.

In addition, in a case where the intermediate gear 38*b* is disposed in front of the intermediate sprocket 38*a*, a space between the intermediate sprocket support shaft 39 and the camshafts 36, 37 needs to be expanded in order to avoid any interference between the intermediate sprocket 38*a* and the camshaft 36, 37, this causing a concern that the area surrounding the camshafts is enlarged.

Here, a backlash adjusting mechanism is provided between the intermediate gear 38*b* and the camshaft gears 41, 42. This adjusting mechanism has a construction in which the intake camshaft gear 41 and the exhaust camshaft gear 42 are made up of two gears such as a driving gear (a power transmission gear) 46 and a shift gear (an adjusting gear) 45 and the angular positions of the driving gear 46 and the shift gear 45 can be adjusted.

Namely, the shift gear 45 and the driving gear 46 are fixed to flange portions 36*b*, 37*b* formed at end portions of the camshafts 36, 37, respectively, in such a manner that the angular positions thereof can be adjusted by four circumferentially long elongated holes 45*a*, 46*a* and four long bolts 68*a*. A clearance portion 46*b* is cut and formed in the driving gear 46 that is disposed outwardly, and only the shift gear 45 is fixed in such a manner that the angular position thereof can be adjusted two elongated holes 45*b* and two short bolts 68*b* by making use of the clearance portion 46.

Figure 3:
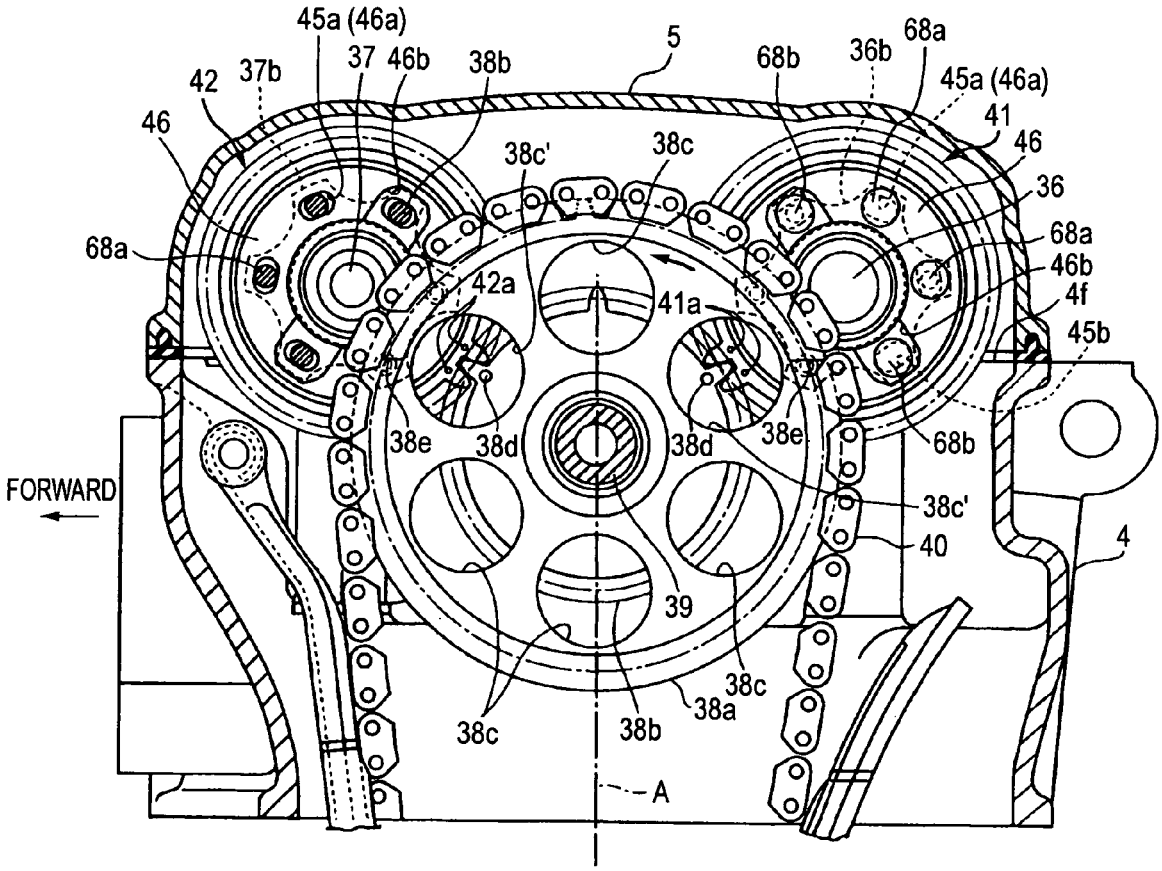
FIG. 3 is a left-hand side view showing a valve train device of the engine.
Figure 4:
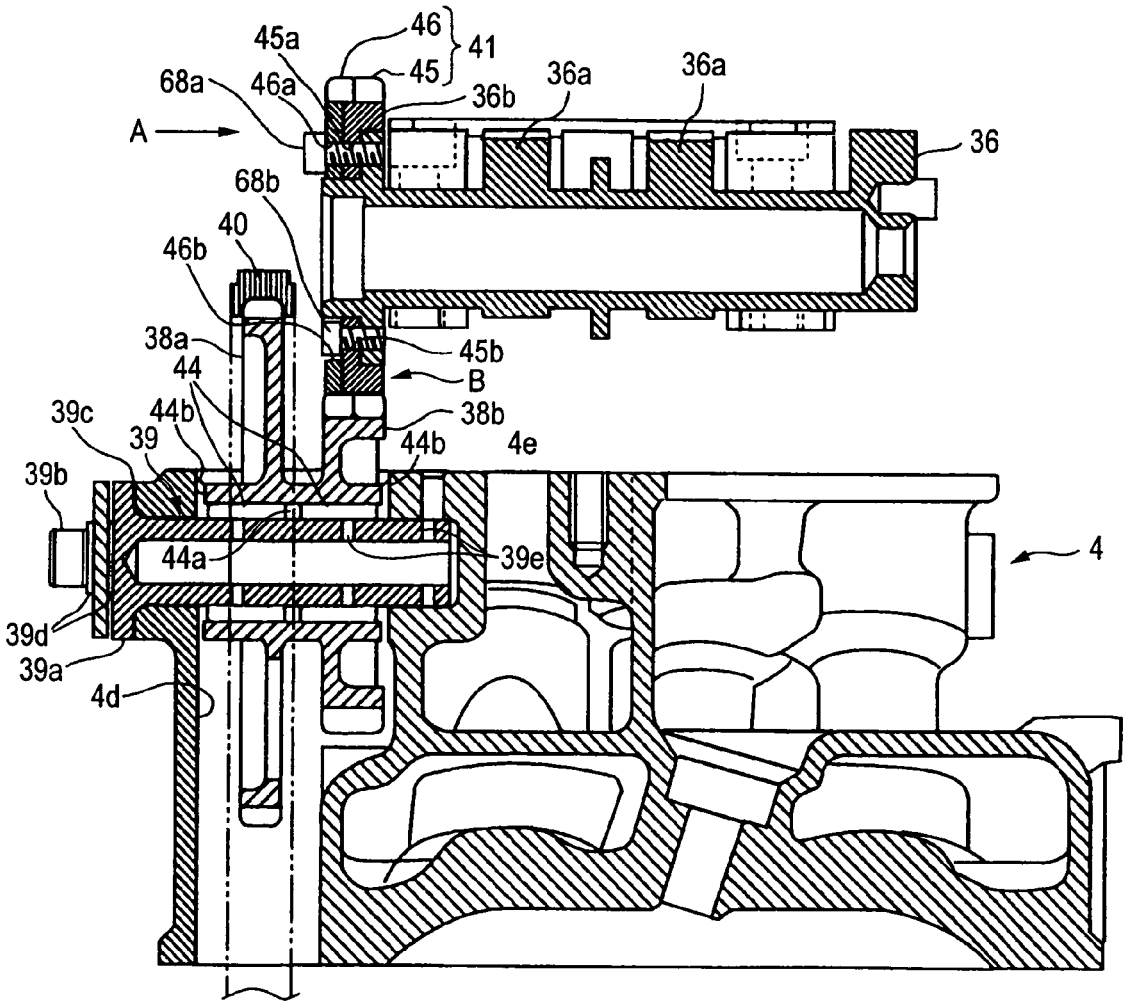
FIG. 4 is a sectional rear elevation of the valve train device.

A backlash adjustment is implemented according to the following procedure. Note that in the engine according to the embodiment, the intermediate gear 38*b* rotates counterclockwise as shown in FIG. 3 when viewed from the left-hand side of the engine. Consequently, both the intake camshaft gear 41 and the exhaust camshaft gear 42 rotate clockwise. In addition, here, while the backlash adjustment will be described with respect to the intake camshaft gear 41, the same description would be made with respect to the exhaust camshaft gear 42.

Firstly, all the fixing bolts 68*a*, 68*b* of the intake camshaft gear 41 are loosened, and the shift gear 45 is rotated clockwise so that front side surfaces of teeth of the shift gear 45 in the clockwise direction slightly abut with rear side surfaces of teeth of the intermediate gear 38*b* in the counterclockwise direction. In this state, the shift gear 45 is fixed to the flange portion 36*b* of the camshaft 36 with two short bolts 68*b*. Then, the driving gear 46 is rotated counterclockwise in such a manner that front side surfaces (driven surfaces) of teeth of the driving gear 46 in the counterclockwise direction abut with front side surfaces (driving surfaces) of the intermediate gear 38*b* in the counterclockwise direction so as to obtain a required backlash, and in this state, four long bolts 68*a* are tightened up, whereby the driving gear 46 and the shift gear 45 are fixed to the intake camshaft 36.

Thus, since the intake and exhaust camshaft gears 41, 42 are made up of the driving gear (power transmission gear) 46 and the shift (adjusting gear) 45 adapted to rotate relatively to the driving gear, respectively, the backlash can be adjusted by rotating the shift gear 45 relatively to the driving gear 46 forward or backward in the rotating directions.

Note that while, in this embodiment, both the driving gear 46 and the shift gear 45 which constitute the camshaft gears 41, 42 are described as being able to rotate relatively to the camshafts, one of the driving gear 46 and the shift gear 45 may be adapted to rotate relatively and the other gear may be integrated into the camshaft. In this case, it is desirable that the gear integrated into the camshaft constitutes the power transmission gear. Even if constructed in this way, similar function and advantage to those obtained by the embodiment can be obtained.

In addition, while in the embodiment, the invention is described as being applied to the construction in which the chain drive method is adopted, the invention can of course be applied to a drive method using a toothed belt.

Next, a lubricating construction will be described. A lubrication system 50 of the engine according to the embodiment is constructed such that lubricating oil stored within a separate lubricating oil tank 51 is picked up and pressurized by a lubricating oil pump 52 via a down tube 56*c* on a vehicle body frame, lubricating oil discharged from the pump 52 is divided into three systems such as a cam lubricating system 53, a transmission lubricating system 54 and a crank lubricating system 55 so as to be supplied to parts needing to be lubricated at the respective systems, and lubricating oil used for lubricating the respective parts needing lubrication is returned to the lubricating oil tank 51 by making use of pressure fluctuation occurring within the crank compartment 2*c* as the piston 6 reciprocates vertically.

The lubricating oil tank 51 is formed integrally within a space surrounded by a head pipe 56*a*, a main tube 56*b*, the down tube 56*c* and a reinforcement bracket 56*d* of the vehicle body frame 56. This lubricating oil tank 51 communicates with a cross pipe 56*e* which connects lower portions of the down tube 56*c* via the down tube 56*c*.

Then, the cross pipe 56*e* communicates with a pick-up port of the lubricating oil pump 52 via an outlet tube 56*f* connected thereto, an oil hose 57*a*, a joint pipe 57*b* and a pick-up passageway 58*a* formed in a crankcase cover 10. A discharge port of the lubricating oil pump 52 is connected to an oil filter 59 via an oil discharge passageway 58*b*, an external portion connecting chamber 58*c* and an oil passageway 58*d* and is divided into the three lubrication systems 53, 54, 55 on a secondary side of the oil filter 59.

The oil filter 59 is constructed such that an oil element 59*e* is disposed in a filter compartment 59*d* defined by detachably attaching a portion of a cover 47 to a filter recessed portion 10*b* provided in the right case cover 10 by setting part thereof further back from the rest.

The cam lubricating system 53 has a construction which is generally constructed such that a lower end of a vertical member 53*a* of a T-shaped lubricating oil pipe is connected to a cam side outlet 59*a* of an oil passageway formed on the outside of the filter recessed portion 10*b*, whereas left and right ends of a horizontal member 53*b* of the lubricating oil pipe are connected to a camshaft oil supply passageway 53*c*, so that lubricating oil is supplied to parts such as bearings of the camshafts 36, 37 which need to be lubricated via the passageway 53*c*.

The transmission lubrication system 54 has the following construction. A right transmission oil supply passageway 54*a* formed within the right case portion 2*b* is connected to a transmission side outlet 59*b* of the oil filter 59, and the oil supply passageway 54*a* communicates with the interior of a main shaft bore 14*a* formed in the main shaft 14 along the axial center thereof via a left transmission oil passageway 54*b* formed in the left case portion 2*a*. Then, this main shaft bore 14*a* communicates with sliding portions between the main shaft 14 and change-speed gears via a plurality of branch bores 14*b*, whereby lubricating oil supplied to the main shaft bore 14*a* passes through the branch bores 14*b* to be supplied to the sliding portions.

In addition, an intermediate portion of the left transmission oil passageway 54*b* communicates with a bolt bore 60*a* through which a case bolt 60 for connecting the left and right case portions 2*a*, 2*b* together is allowed to pass. This bolt bore 60*a* is such as to be formed by forming a bore having an inside diameter which is slightly larger than the outside diameter of the case bolt 60 in tubular boss portions 60*c*, 60*c* which are formed so as to face and abut with each other on the mating surface between the left and right case portions 2*a*, 2*b*. The boss portion 60*c* is situated in the vicinity of a portion where a gear train on the main shaft 14 meshes with a gear train on the drive shaft 15, and a plurality of branch bores 60*b* are formed from which lubricating oil within the bolt bore 60*a* is spouted out toward the gear trains meshing portion. Note that the bolts 60 shown in FIG. 19 as being developed into the left and right case portions are the same bolt.

Furthermore, a right end portion of the bolt bore 60*a* communicates with a drive shaft bore 15*a* formed in the drive shaft 15 along the axial center thereof via a communication bore 54*c*. Then, the drive shaft bore 15*a* is closed by a partition wall 15*c* at a left-hand side portion and communicates with sliding portions between the drive shaft 15 and driving gears via a plurality of branch bores 15*b*. Thus, lubricating oil supplied into the drive shaft bore 15*a* passes through the branch bores 15*b* to be supplied to the sliding portions.

The crank lubricating system 55 has the following construction. A crank oil supply passageway 55*a* is formed in the filter cover 47 in such a manner as to extend from a crank side outlet 59*c* toward the lubricating oil pump 52, and the passageway 55 is made to communicate with a communication bore 62*a* which is formed in a rotating shaft 62 of the lubricating oil pump 52 to pass therethrough along the axial center thereof. Furthermore, the communication bore 62*a* communicates with a crank oil supply bore 8*e* formed in the crankshaft 8 to pass therethrough along the axial center thereof via a connecting pie 64. Then, this crank oil supply bore 8*e* communicates with the interior of a pin bore 65*a* in a crank pin 65 via a branch bore 8*f*, and the pin bore 65*a* is made to open to the rotating surface of a needle bearing 7*b* at a big end portion 7*a* of a connecting rod 7 via a branch bore 65*b*. Thus, lubricating oil filtered in the oil filter 59 is supplied to the rotating surface of the needle bearing 7*b*.

The lubricating oil pump 52 has the following construction. A pump compartment 61*c* is provided in a right case 61*b* of a two-piece casing made up of left and right cases 61*a*, 61*b* by setting a relevant portion of the case further back from the rest, and a rotor 63 is disposed rotationally within the pump compartment 61. The rotating shaft 62 is inserted into the rotor 63 along the axial center thereof in such a manner as to pass therethrough to be disposed in place therein, and the rotating shaft 62 and the rotor 63 are fixed together with a pin 63*a*. Note that the oil pick-up passageway 58*a* and oil discharge passageway 58*b* are connected to a pump compartment upstream side and a pump compartment downstream side of the left case 61*a*, respectively. In addition, reference numeral 66 denotes a relief valve for retaining the discharge pressure of the lubricating oil pump 52 to a predetermined value of lower and adapted to relieve the pressure on the discharge side of the lubricating oil pump 52 to the oil pick-up passageway 58*a* side when the pressure on the discharge side reaches or exceeds the predetermined value.

The rotating shaft 62 is a tubular shaft which passes through the pump case 61 in the axial direction and opens to the crank oil supply passageway 55*a* at a right end portion thereof as shown in the drawing. In addition, a power transmitting flange portion 62*b* is formed integrally at a left end portion of the rotating shaft 62 as shown in the drawing. The flange portion 62*b* faces a right end face of the crankshaft 8, and the flange portion 62*b* and the crankshaft 8 are connected together by an Oldham's coupling 67 in such a manner as to absorb a slight deviation of the centers of the shafts.

The Oldham's coupling 67 is constructed such that a coupling plate 67*a* is disposed between the crankshaft 8 and the flange portion 62*b*, a pin 67*b* planted in the end face of the crankshaft 8 and a pin 67*c* planted in the flange portion 62*b* are inserted into a connecting bore 67*d* in the coupling plate 67*a*.

In addition, the connecting pipe 64 is such as to connect a right end opening in the crankshaft 8 to a left end opening in the rotating shaft 62, and sealing is provided by an oil seal 64*a* between the inner circumference of the crankshaft opening and the inner circumference of the rotating shaft opening and the outer circumference of the connecting pipe 64.

Here, as has been described above, the crank compartment 2*c* is defined separately from the other transmission compartment 2*d*, the flywheel magnet compartment 9*a* and the clutch compartment 10*a*, whereby an oil return mechanism is constructed in which the pressure within the crank compartment 2*c* is fluctuated to be positive and negative as the piston 6 strokes, so that lubricating oil in the respective compartments is returned to the lubricating oil tank 51 by virtue of the pressure fluctuation.

To describe this in detail, a discharge port 2*g* and a suction or pick-up port 2*h* are formed in the crank compartment 2*c*. A discharge port reed valve 69 adapted to open when the pressure within the crank compartment is positive is disposed in the discharge port 2*g*, and a pick-up port reed valve 70 adapted to open when the pressure within the crank compartment is negative is disposed in the pick-up port 2*h*.

Then, the discharge port 2*g* communicates with the clutch compartment 10*a* from the crank compartment 2*c* via a communication bore 2*i* and then communicates with the transmission compartment 2*d* from the clutch compartment 10*a* via a communication bore 2*j*. Furthermore, the transmission compartment 2*d* communicates with the flywheel magnet compartment 9*a* via a communication bore 2*k*. A return port 2*m* formed so as to communicate with the flywheel magnet compartment 9*a* communicates with the lubricating oil tank 51 via a return hose 57*c*, an oil strainer 57*d* and a return hose 57*e*.

Here, a guide plate 2*n* is provided at the return port 2*m*. This guide plate 2*n* has a function to ensure the discharge of lubricating oil by modifying the return port 2*m* so as to provide a narrow gap a between a bottom plate 2*p* and itself and to secure a wide width b.

Additionally, an oil separating mechanism for separating oil mists contained in the air within the tank by virtue of centrifugal force so as to return oil mists so separated to the crank compartment 2*c*. This oil separating mechanism has a construction in which an introduction hose 72*a* which is connected to an upper portion of the lubricating oil tank 51 at one end thereof is tangentially connected to an upper portion of a cone-shaped separating compartment 71 at the other end and a return hose 72*b* connected to a bottom portion of the separating compartment 71 is connected to the pick-up port 2*h* of the crank compartment 2*c*. Note that the air from which the oil mists are separated is discharged to the atmosphere via an exhaust hole 72*c*.

Thus, according to the embodiment, since the crank chamber 2*c* is made to be a substantially closed space so that the pressure therein fluctuates as the piston 6 reciprocates vertically, whereby lubricating oil that has flowed into the crank compartment 2*c* is sent back to the lubricating oil tank 51 by virtue of pressure fluctuation within the crank compartment 2*c*, the necessity of an exclusive oil sending pump (a scavenging pump) can be obviated, and hence the construction of the engine can be simplified and costs can be attempted to be reduced.

In addition, since the discharge port reed valve (an outlet side check valve) 69 adapted to open when the pressure in the crank compartment increases and to close when the pressure lowers is disposed in the vicinity of where the oil sending passageway is connected to the crank compartment 2*c*, the lubricating oil within the crank compartment 2*c* can be sent back to the lubricating oil storage tank 51 in a more ensured fashion.

In addition, since an portion above the oil level within the lubricating oil storage tank 51 is connected to the crank compartment 2 via the return hoses 72*a*, 72*b* and the discharge port reed valve (a pick-up side check valve) 70 adapted to open when the pressure in the crank compartment 2*c* lowers and to close when the pressure increases is provided in the vicinity where the return hoses are connected to the crank compartment 2*c*, air required is picked up into the crank compartment 2*c* when the piston 6 moves upwardly, whereas the inside pressure of the crank compartment 2*c* increases as the piston 6 lowers, whereby lubricating oil within the crank compartment 2*c* can be sent tout in a more ensured fashion.

Incidentally, in a case where there is provided no air supply path from the outside to the interior of the crank compartment 2*c*, only a negative pressure or a lower positive pressure is formed inside the crank compartment, this causing a concern that there occurs a case where oil cannot be sent out properly.

Furthermore, since the centrifugal lubricating oil mist separating mechanism 71 for separating lubricating oil mist is interposed at the intermediate position along the length of the return passageways 72*a*, 72*b*, so that lubricating oil mist so separated is returned to the crank compartment 2*c* via the return hose 72*b*, whereas air from which the mist content is removed is discharged to the atmosphere, only lubricating oil mist can be returned to the crank compartment, whereby the reduction in oil sending efficiency can be avoided which would occur when an excessive amount of air is allowed to flow into the crank compartment, thereby making it possible to send out lubricating oil in the crank compartment in an ensured fashion while preventing the atmospheric pollution.

In addition, since the lubricating oil pump 52 is disposed so as to be connected to the one end of the crankshaft 8 and the discharge port of the lubricating oil pump 52 is made to communicate with the crank oil supply bore (an in-crankshaft oil supply passageway) 8*e* formed within the crankshaft 8 via the communication bore (an in-pump oil supply passageway) 62*a* formed within the lubricating oil pump 52 and the connecting pipe 64, the lubricating oil can be supplied to the parts of the crankshaft 8 which need to be lubricated by the simple and compact construction.

In addition, since the crankshaft 8 and the lubricating oil pump 52 are connected together by the Oldham's coupling 67 which can absorb the displacement of the shafts in the direction normal thereto and the communication bore 62*a* and the crank oil supply bore 8*e* are made to communicate with each other via the connecting pipe 64 with the O rings 64*a* having elasticity being interposed between the connecting pipe 64 and the communicating bore 62*a*, the crank oil supply bore 8*e*, even in the event that the centers of the crankshaft 8 and the pump shaft 62 are caused to deviate slightly from each other, lubricating oil can be supplied to the parts needing to be lubricated without any problem, thereby making it possible to secure the required lubricating properties.

Furthermore, since the tubular boss portion 60*c* is formed in the vicinity of the main shaft 14 and the drive shaft 15 which constitute the transmission, the crankcase connecting case bolt 60 is inserted into the bolt bore 60*a* in the boss portion 60*c* so that the space between the inner circumferential surface of the bolt bore 60*a* and the outer circumferential surface of the case bolt 60 is made to form the lubricating oil passageway, and the branch bore (the lubricating oil supply bore) 60*b* is formed which is directed to the change-speed gears at the boss portion 60*c*, lubricating oil can be supplied to the meshing surfaces of the change-speed gears while obviating the necessity of providing an exclusive lubricating oil supply passageway.

In addition, since the other end of the lubricating oil passageway defined by the inner circumferential surface of the bolt bore 60*c* and the outer circumferential surface of the case bolt 60 is made to communicate with an opening of the drive shaft bore (the lubricating oil passageway) 15*a* formed within the drive shaft 15 which is situated opposite to an outlet side of the bore, lubricating oil can be supplied to the portions on the drive shaft 15 which are brought into sliding contact with the change-speed gears while obviating the necessity of providing an exclusive lubricating oil supply passageway.

INDUSTRIAL APPLICABILITY

According to the first and tenth aspects of the invention, since at least the part of head bolts which fasten the cylinder head and the cylinder body together are screwed into the case side flange portion, the load applied to the cylinder body is reduced by such an extent that the load generated by the combustion pressure is partially borne by the head bolts, and hence the stress generated in the cylinder body can be reduced accordingly, thereby making it possible to improve the durability of the cylinder body.

Namely, in the case of a construction, for example, in which a head side flange portion of a cylinder body and a cylinder head are simply fastened together with bolts and a case side flange portion and a crankcase are simply fastened together with bolts, the load generated by the combustion pressure is totally applied to the cylinder body, and the durability of the cylinder body becomes insufficient depending upon the thickness of the cylinder body, and in the worst case, there exists a concern that a crack is generated in the cylinder body. According to the invention, however, a problem like this can be avoided.

According to the second aspect of the invention, since the flange screw-through head bolt and the case bolt overlap each other by the distance which is substantially the same as the thickness of the case side flange portion, the flange screw-through head bolts can ensure the transmission of part of the load generated by the combustion pressure to the case side flange portion, thereby making it possible to reduce the load applied to the intermediate portion of the cylinder body.

According to the third aspect of the invention, since the flange screw-through bolt and the case bolt are disposed close to each other, when viewed in the axial direction of the cylinder bore, the flange screw-through head bolts can ensure further the transmission of part of the load generated by the combustion pressure to the case side flange portion, and furthermore, the case side flange portion can in turn ensure the transmission of the load so transmitted thereto to the crankcase via the case bolts, thereby making it possible to reduce the load applied to the cylinder body in an ensured fashion.

According to the fourth aspect of the invention, since the case bolt is disposed such that the distance from the case bolt to the first straight line which passes through the axis of the cylinder bore and which is normal to the crankshaft becomes shorter than the distance from the flange screw-through head bolt to the first straight line, when viewed in the axial direction of the cylinder bore, or such that the case bolts are situated closer to the center of the cylinder bore in the crankshaft direction, the dimension in the crankshaft direction of the mating surface of the crankcase which is attached to the cylinder body can be reduced to the vicinity of the positions where the flange screw-through head bolts are disposed, and as a result, the dimension in the crankshaft direction of the crankcase can be reduced.

According to the fifth aspect of the invention, since the construction is adopted in which the flange screw-through head bolts are screwed into the case side flange portion of the cylinder body or the flange screw-through head bolts are not screwed into the crankcase, there exists no risk that a problem is caused of the flange screw-through head bolts interfering with the crankshaft web incorporated in the crankcase, so that the flange screw-through head bolts can be disposed such that the distance to the second straight line which passes through the axis of the cylinder bore and which is parallel to the crankshaft becomes shorter than the distance from the case bolt to the second straight line or such that the flange screw-through head bolts can be situated closer to the crankshaft side, whereby the dimension of the cylinder body in the direction normal to the crankshaft can be reduced.

According to the sixth aspect of the invention, since the axial part of the flange screw-through head bolt is exposed to the outside, the weight of the cylinder body can be reduced.

According to the seventh aspect of the invention, since at least the three head bolts are disposed on either side of the cylinder bore across the second straight line, the central head bolt along the second straight line is caused to be situated apart from the axis of the cylinder. However, since the head bolt is set to have the length which does not reach the case side flange portion, the portion of the case side flange portion which corresponds to the center can be minimized, thereby making it possible to avoid the enlargement of the cylinder body and the crankcase.

According to the eighth aspect of the invention, since the flange screw-through head bolt is disposed between the cylinder bore and the chain compartment formed on the side to the cylinder bore, the flange screw-through head bolt can be disposed by making the effective use of the dead space formed therebetween.

According to the ninth aspect of the invention, since the flange screw-through head bolt is screwed into the case side flange portion at one end and is fastened and fixed to the cylinder head with the cap nut at the other end thereof, the cylinder head can be removed without securing a large space above the cylinder head, thereby making it possible to secure the maintenance properties of the engine.

The invention claimed is:

1. An engine fastening structure in which a cylinder body and a cylinder head are stacked on and fastened to a crankcase, characterized in that case bolts pass through a case side flange portion formed at a crankcase side end portion of the cylinder body and are screwed into a cylinder body side end portion of the crankcase to fasten the cylinder body to the crankcase, in that at least part of head bolts which fasten the cylinder head and the cylinder body together is made to be a flange screw-through head bolt, and in that the flange screw-through head bolt is screwed into a screw portion formed in the case side flange portion.

2. An engine fastening structure as set forth in claim 1, characterized in that the flange screw-through head bolt and the case bolt overlap each other by a distance which is substantially the same as the thickness of the case side flange portion in the axial direction of a cylinder bore.

3. An engine fastening structure as set forth in claim 1 or 2, characterized in that the flange screw-through bolt and the case bolt are disposed close to each other, when viewed in the axial direction of the cylinder bore.

4. An engine fastening structure as set forth in claim 3, characterized in that the case bolt is disposed such that a distance from the case bolt to a first straight line which passes through the axis of the cylinder bore and which is normal to a crankshaft becomes shorter than a distance from the flange screw-through head bolt to the first straight line, when viewed in the axial direction of the cylinder bore.

5. An engine fastening structure as set forth in claim 4, characterized in that the flange screw-through head bolt is disposed such that a distance from the head bolt to a second straight line which passes through the axis of the cylinder bore and which is parallel to the crankshaft becomes shorter than a distance from the case bolt to the second straight line, when viewed in the axial direction of the cylinder bore.

6. An engine fastening structure as set forth in claim 5, characterized in that an upper flange portion is formed at a cylinder head side end portion of the cylinder body, in that the flange screw-through head bolt passes the upper flange portion and is screwed into the case side flange portion, and in that a part of the flange screw-through head bolt which is between the case side flange portion and the upper flange portion is exposed to the outside.

7. An engine fastening structure as set forth in claim 6, characterized in that at least three head bolts are disposed on either side of the cylinder bore across the second straight line, when viewed in the axial direction of the cylinder bore, and in that the central head bolt along the second straight line is set to have a length which does not reach the case side flange portion.

8. An engine fastening structure as set forth in claim 7, characterized in that the flange screw-through head bolt is disposed between a chain compartment formed on a side to the cylinder bore in which a camshaft driving chain which connects the crankshaft to a camshaft is disposed and the cylinder bore.

9. An engine fastening structure as set forth in claim 8, characterized in that the flange screw-through head bolt is screwed into the case side flange portion at one end and is fastened and fixed to the, cylinder head with a cap nut at the other end thereof.

10. An engine fastening structure as set forth in claim 1, characterized in that a tip of the flange screw-through head bolt is positioned closer to a cylinder body side than a cylinder body side end surface of the crankcase.

* * * * *